US009682790B2

(12) United States Patent
Nelson

(10) Patent No.: US 9,682,790 B2
(45) Date of Patent: Jun. 20, 2017

(54) PALLET SECURING MECHANISM

(71) Applicant: Encore Packaging LLC, Lake Bluff, IL (US)

(72) Inventor: Timothy H. Nelson, Winnetka, IL (US)

(73) Assignee: Encore Packaging LLC, Lake Bluff, IL (US)

( * ) Notice: Subject to any disclaimer, the term of this patent is extended or adjusted under 35 U.S.C. 154(b) by 859 days.

(21) Appl. No.: 13/920,189

(22) Filed: Jun. 18, 2013

(65) Prior Publication Data

US 2014/0109523 A1 Apr. 24, 2014

Related U.S. Application Data

(63) Continuation-in-part of application No. 13/827,787, filed on Mar. 14, 2013, which is a continuation-in-part of application No. 13/797,372, filed on Mar. 12, 2013.

(60) Provisional application No. 61/716,666, filed on Oct. 22, 2012.

(51) Int. Cl.

| | |
|---|---|
| ***B65B 11/00*** | (2006.01) |
| ***B65B 61/02*** | (2006.01) |
| ***B65B 67/08*** | (2006.01) |
| ***B65B 11/04*** | (2006.01) |
| ***B65D 71/00*** | (2006.01) |

(52) U.S. Cl.

CPC ..... *B65B 11/006* (2013.01); *B65B 11/045* (2013.01); *B65B 61/02* (2013.01); *B65B 67/085* (2013.01); *B65D 71/0096* (2013.01); *B65D 2571/00018* (2013.01)

(58) Field of Classification Search

CPC ..... B65D 2571/00055; E04G 7/28

See application file for complete search history.

(56) References Cited

U.S. PATENT DOCUMENTS

| | | | | |
|---|---|---|---|---|
| 1,895,766 A * | 1/1933 | Murphy | E04G 7/28 | 403/399 |
| 2,351,525 A * | 6/1944 | Leary | E04B 2/842 | 403/231 |
| 2,385,209 A * | 9/1945 | Joyce | F16L 3/24 | 24/339 |
| 2,564,517 A * | 8/1951 | Beals | G09F 3/20 | 248/229.26 |

(Continued)

FOREIGN PATENT DOCUMENTS

WO 9207761 A1 5/1992

OTHER PUBLICATIONS

Western Plastics Internet Page; "Air-Flow Overview"; http://www.wplastics.com/articles/af_article_004.asp; 2 pages. Available at least as early as Mar. 9, 2013.

(Continued)

*Primary Examiner* — Victor MacArthur

(74) *Attorney, Agent, or Firm* — Fitch, Even, Tabin & Flannery LLP

(57) ABSTRACT

Attachment apparatuses are attached to a pallet to allow rope or string, such as that made from stretch film, to securely attach a load or object to the pallet for shipping. The apparatuses can be clip or nail based to secure to the pallet or wedge based to wedge into the middle of the pallet. These devices orient an engagement surface designed to engage the rope or string.

8 Claims, 26 Drawing Sheets

(56) References Cited

U.S. PATENT DOCUMENTS

| | | | | | |
|---|---|---|---|---|---|
| 3,754,636 | A * | 8/1973 | Boy | B65G 17/42 198/850 |
| 3,836,106 | A * | 9/1974 | Gray | E04G 5/00 24/350 |
| 3,969,793 | A * | 7/1976 | Crosby | A47C 31/06 24/347 |
| 4,102,513 | A | 7/1978 | Guard | |
| 4,166,589 | A | 9/1979 | Hoover | |
| 4,255,918 | A | 3/1981 | Lancaster | |
| 4,271,657 | A | 6/1981 | Lancaster | |
| 4,336,679 | A | 6/1982 | Lancaster | |
| 4,387,552 | A | 6/1983 | Lancaster | |
| 4,535,951 | A | 8/1985 | Riemenschneider | |
| 4,671,043 | A | 6/1987 | Forni | |
| 4,807,427 | A | 2/1989 | Casteel | |
| 4,905,451 | A | 3/1990 | Jaconelli et al. | |
| 5,125,209 | A | 6/1992 | Thimon | |
| 5,168,685 | A | 12/1992 | Suzuki | |
| 5,447,009 | A | 9/1995 | Oleksy | |
| 5,531,393 | A | 7/1996 | Salzsauler | |
| D393,201 | S * | 4/1998 | Hearidge | D8/395 |
| 5,884,857 | A | 3/1999 | Martin-Cocher | |
| D415,570 | S * | 10/1999 | Bradshaw | D24/224 |
| 6,009,681 | A * | 1/2000 | Kozloff | E04B 1/2608 403/237 |
| D448,987 | S * | 10/2001 | Davis | D8/394 |
| 6,360,512 | B1 | 3/2002 | Marois | |
| 6,450,515 | B1 * | 9/2002 | Guth | B60B 33/0063 16/30 |
| 6,663,069 | B1 * | 12/2003 | Norberg | F21V 21/08 24/339 |
| 6,874,297 | B2 | 4/2005 | Solis et al. | |
| D545,183 | S * | 6/2007 | French | D8/394 |
| D552,463 | S * | 10/2007 | French | D8/395 |
| 7,357,349 | B1 | 4/2008 | Huang | |
| D578,383 | S * | 10/2008 | Adams | D8/367 |
| 7,581,368 | B1 | 9/2009 | Bison | |
| D608,189 | S * | 1/2010 | Jackson | D8/395 |
| 7,779,607 | B2 | 8/2010 | Lancaster, III et al. | |
| 7,908,831 | B1 | 3/2011 | Dugan | |
| 8,037,660 | B2 | 10/2011 | Lancaster, III et al. | |
| 8,053,056 | B2 | 11/2011 | Heikaus | |
| 8,099,935 | B2 | 1/2012 | Forni | |
| D663,357 | S * | 7/2012 | Bookhamer | D19/81 |
| D669,773 | S * | 10/2012 | Colasse | D8/395 |
| 8,276,346 | B2 | 10/2012 | Lancaster, III et al. | |
| 8,276,354 | B2 | 10/2012 | Lancaster, III et al. | |
| D675,512 | S * | 2/2013 | Gary | D8/395 |
| 8,549,819 | B1 | 10/2013 | Bison | |
| 8,707,664 | B1 | 4/2014 | Bison | |
| D729,025 | S * | 5/2015 | Chance | D8/42 |
| 2005/0123721 | A1 | 6/2005 | Heikaus | |
| 2007/0095991 | A1 * | 5/2007 | Fall | A45F 5/02 248/229.26 |
| 2007/0204565 | A1 | 9/2007 | Lancaster, III et al. | |
| 2011/0120056 | A1 | 5/2011 | Smith | |
| 2011/0233321 | A1 | 9/2011 | Yu Chen | |
| 2014/0109523 | A1 | 4/2014 | Nelson | |
| 2014/0331609 | A1 | 11/2014 | Bison | |

OTHER PUBLICATIONS

Western Plastics Internet Page; "Air-Flow Premium Stretches 200% and Works on All Brand Name Equipment"; http://www.wplastics.com/airflow_premium.asp; 2 pages. Available at least as early as Mar. 9, 2013.

Western Plastics Internet Page; "Air-Flow Premium"; http://www.wplastics.com/pg_ind_page12.asp; 2 pages. Available at least as early as Mar. 9, 2013.

Western Plastics Internet Page; "Air-Flow Sales Soar!"; http://www.wplastics.com/airflow.asp; 2 pages. Available at least as early as Mar. 9, 2013.

Western Plastics Internet Page; "Air-Flow"; http://www.wplastics.com/pg_ind_page11.asp; 2 pages. Available at least as early as Mar. 9, 2013.

Western Plastics Internet Page; "Can Air-Flow Solve Your Problems?"; http://www.wplastics.com/articles/af_article_003.asp; 2 pages. Available at least as early as Mar. 9, 2013.

Western Plastics Internet Page; "Distributor's Air-Flow Hit List"; http://www.wplastics.com/articles/af_article_002.asp; 2 pages. Available at least as early as Mar. 9, 2013.

Western Plastics Internet Page; "How to Apply Air-Flow for the Best Results"; http://www.wplastics.com/articles/af_article_006.asp; 2 pages. Available at least as early as Mar. 9, 2013.

Western Plastics Internet Page; "Seven Reasons Why You Should Sell Air-Flow"; http://www.wplastics.com/articles/af_article_001.asp; 2 pages. Available at least as early as Mar. 9, 2013.

* cited by examiner

PALLET SECURING MECHANISM

RELATED APPLICATIONS

This application is a continuation in part of U.S. application Ser. No. 13/827,787 filed Mar. 14, 2013, which is a continuation in part of U.S. application Ser. No. 13/797,372 filed Mar. 12, 2013, which claims the benefit of U.S. provisional patent application No. 61/716,666 filed Oct. 22, 2012, each of which is incorporated by reference herein in their entireties.

TECHNICAL FIELD

The invention relates generally to the packaging industry and, more specifically, to application of stretch film or wrap to objects.

BACKGROUND

Stretch film or wrap is generally known in the industry as a material that can be used to securely wrap a collection of objects together using the stretch material's resiliency and clinginess. Stretch wrap is typically understood to be a polyethylene stretch film that is generally dispensed from a roll form for use in a variety of applications. For instance, stretch wrap is held against a collection of objects and dispensed and stretched around the collection of objects and wrapped over itself up to several times to cover and hold together the collection of objects. In the shipping industry, for example, a collection of materials may be placed on a pallet to secure such articles together during the shipping process. A collection of boxes placed on a pallet can be shipped as a single cohesive unit when bound together through wrapping with stretch wrap. Other applications of stretch wrap are known such as wrapping agricultural products or simply binding together a collection of items.

Although such usages for stretch wrap are well known and documented, the amount of stretch wrap used in any given application can be extensive. For example, for an industrial supplier that ships large numbers of pallets of materials out on a consistent basis, a large inventory of stretch wrap must be maintained to facilitate the regular shipment of such products. For example, a large amount of stretch film may be necessary to wrap a given pallet of materials.

Typically, during application, a tension is applied to the stretch film as it is applied to the objects being wrapped. This tension stretches the film to facilitate a secure binding of the wrapped objects together, and this tension process also both strengthens the stretch film and allows for the use of less film. In typical approaches, the stretch creates a lengthening of the stretch wrap, but also creates significant narrowing of the stretch wrap in the direction not under tension. The narrowing causes less coverage of the object being wrapped and eliminating much of the efficiency gained in stretching the stretch wrap. One known device includes an idler roller that engages and rotates with the stretch wrap as it is pulled from its roll. The idler roller facilitates stretching of the wrap along its length due to the tension on the film. The roller also generally maintains the film's flat shape as it engages the object around which it is being wrapped. Although this stretch is advantageous, some narrowing does occur and further stretch and strength is still desirable. Another known approach is to stretch the stretch wrap with tension in the long direction while holding the sides of the stretch wrap to reduce narrowing. Such an approach is largely done through complex and expensive machinery. Another common application for stretch film is the containment and shipment of agricultural products where these products need to be ventilated to avoid spoilage or for evaporation of water. Current applications use stretch film that has holes cut into the film to allow the film to breath. This process is either done in-line during the manufacturing of the stretch film with expensive equipment or done off line as a secondary operation using expensive equipment to wind, perforate and then rewind the film.

Moreover, it is common to secure the wrapped objects to the pallet through use of one or more straps. Such straps are typically metal bands that wrap over the object and through the pallet's body. The metal band has two ends that are pulled tight and clamed together to secure the load to the pallet. Such strapping is expensive and generally not reusable.

SUMMARY

Generally speaking and pursuant to these various embodiments, a stretch wrap manipulator is provided that includes one or more cutting members arranged, for instance, in parallel and designed to engage the stretch wrap to cut it into strips as it is dispensed from the roll. The strips are then gathered and stretched into strings that are wrapped around the object. The strings formed from the stretch wrap can stretch to an extended length while maintaining excellent tensile strength to secure heavy loads. Accordingly, such approaches save on the volume of stretch wrap used to secure a load without significantly compromising strength as a result of the stretching action while gathering the strips into strings. It also successfully wraps the load while providing the ventilation needed that is commonly provided by the more expensive vented film.

In some cases, there is a need to provide additional strength to certain section of the load and/or to grab the side of a pallet with a string of film rather than the face of the film. The gathering device allows a user to quickly and efficiently create a methodology of converting the face of the film to a concentrate string of film. This string allows the user to provide additional strength to a specific area on the pallet or tie the film off onto the bottom of the pallet.

In one described example, one or more cutting blades are disposed along a width of the stretch wrap where it separates from the roll. Beyond the cutting blades are gathering devices that gather individual strips of the stretch wrap into strings. The end of the stretch wrap is engaged to the object being wrapped such that the stretch wrap is under tension as it is removed from the roll, cut, and gathered into strings. The gathering devices apply this tension to the strips to stretch the strips as they are gathered together into the strings while passing through the gathering devices. This stretching can effect a significant increase in the length of the stretch wrap available to wrap around the object. It also creates a product that allows for the natural venting of the pallet. It also allows the film to be used in a concentrated area of the pallet. The strings or ropes can be secured to the pallet in a variety of ways, including through attachment to devices secured to the pallet.

The increase in stretch and gathering into strings of the stretch wrap results in a strong material that can hold together large loads while reducing the overall amount of stretch wrap used. So configured, efficiency of use of the stretch wrap increases. In addition, it provides for gaps between the stretch film which will allow the product to vent. These and other benefits may become clearer upon making a thorough review and study of the following detailed description.

BRIEF DESCRIPTION OF THE DRAWINGS

The above needs are at least partially met through provision of the stretch wrap dispenser described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
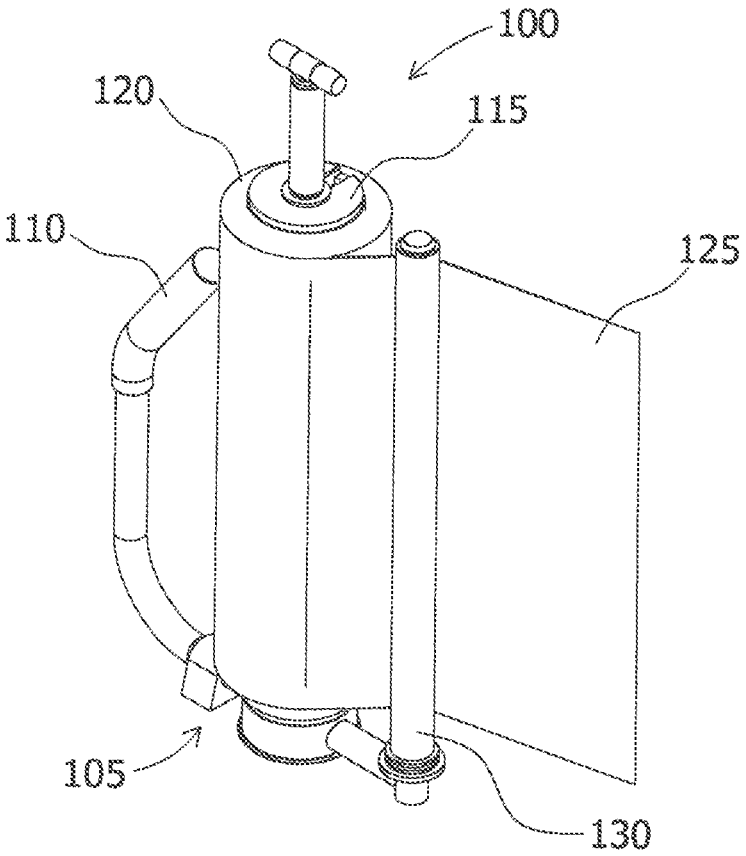
FIG. 1 comprises a perspective view of a prior art stretch film dispenser.

Referring now to the drawings and, in particular to FIG. 1, a prior art stretch film dispenser 100 is illustrated. The stretch film dispenser includes a frame having a handle 105 extending from the frame, a rotatable support 115 is configured to engage and hold a roll 120 of stretch film and rotate with the roll 120 as the stretch film 125 is pulled and removed from the roll 120. The rotatable support or arm 115 is rotatably supported by the frame 105 using ball bearings or other rotatable supports as known in the art. The frame 105 also supports an elongated member 130 that extends next to the roll 120 and is disposed to engage the stretch film 125 as it dispenses from the roll 120. In use, the stretch film 125 engages an object to be wrapped and is kept in tension as the stretch film is dispensed from the roll 120 and applied to the object. The tension on the stretch film 125 stretches the stretch film 125 along its length as it is dispensed from the roll 120. The elongated member 130 facilitates stretching of the stretch wrap 125 as it engages the stretch wrap 125 during dispensing.

Figure 2:
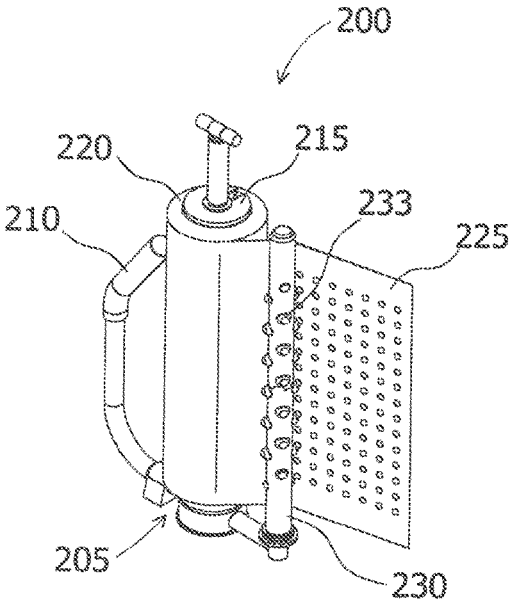
FIG. 2 comprises a perspective view of an example stretch film dispenser as configured in accordance with various embodiments of the invention.

FIG. 2 illustrates an example stretch film dispensing apparatus 200 for applying a stretch film to an object. The stretch film dispensing apparatus 200 includes a support frame 205, including an extension handle 210 that facilitates manual application of stretch film to an object. The frame 205 can be made of any suitable material such as a metal such as steel or plastic having sufficient strength to support the various aspects of the stretch film dispenser 200 against the forces experienced during stretch film application. One of skill in the art will recognize that the teachings of this disclosure are not limited to hand application of stretch film and may be applied to mechanical or automatic application of stretch wrap or film to objects. A support 215 is configured to support a roll 220 of stretch film and dispense the stretch film in response to tension on the stretch film 225. The support 215 may be a rotatable arm or an elongated element designed to engage a hollow center of a stretch film roll, gripping members designed to engage either end of a stretch film roll, or other design suitable to support a roll of stretch film for dispensing.

The frame 205 also supports at least one member 230 having protrusions 233 configured to engage the stretch film 225 after the stretch film 225 extends from the roll 220 and before the stretch film 225 contacts the object. The protrusions 233 are configured to distort or variably stretch the stretch film 225 along a length of the stretch film 225 engaging the at least one member 230. In the example of FIG. 2, the at least one member is disposed generally parallel to the roll 220 and is an elongated rotatable member that is cylindrical with the protrusions extending out from a radius of the cylinder. The frame 205 in the illustrated example supports the member 230 in a rotatable fashion using roller bearings or other suitable means known in the art such that the member 230 rotates as the stretch film 225 is dispensed and rolls over the member 230. In this way, the protrusions 233 engage and release the stretch film 225 to deform it as the member 230 rolls with the dispensed stretch film 225. The member 230 can be formed out of any of a variety of materials having sufficient stiffness to deform the stretch film. For example, the member 230 can be a pre-formed plastic piece to reduce adhesion between the stretch wrap and the member 230. Also, the member 230 can have any of a variety of cross sectional shapes or be irregularly shaped including optionally protrusions that intentionally pierce the film to give it extra elongation or some type of ventilation. The protrusions also can have a variety of forms as discussed below. These protrusions could also be applied off line during the manufacturing of the stretch film.

Figure 4:
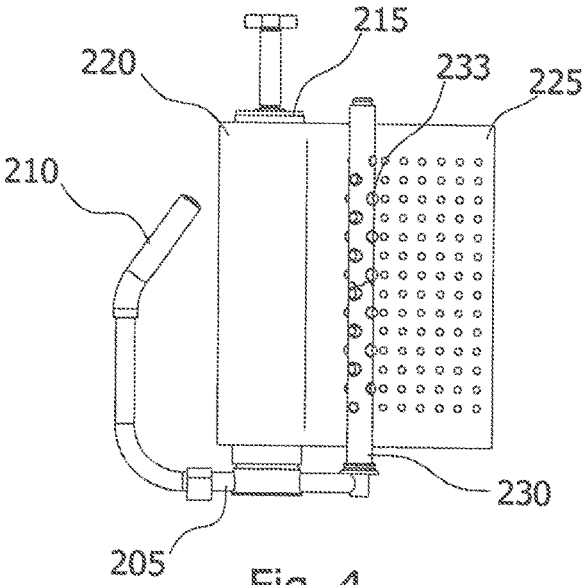
FIG. 4 comprises a side view of the example stretch film dispenser of FIG. 2.
Figure 5:
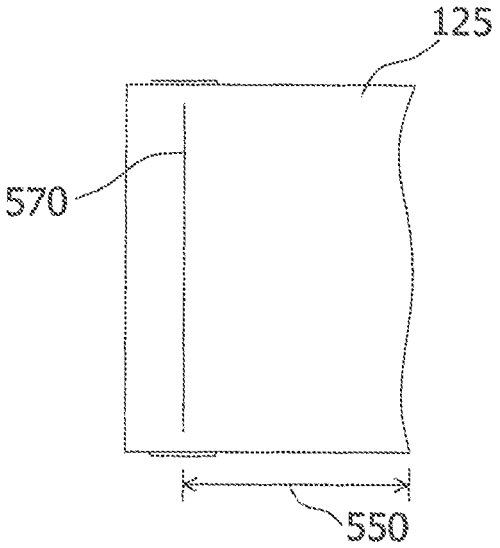
FIG. 5 comprises a side view of stretch film pulled from a roll of stretch film using a stretch film dispenser similar to that of FIG. 1.
Figure 6:
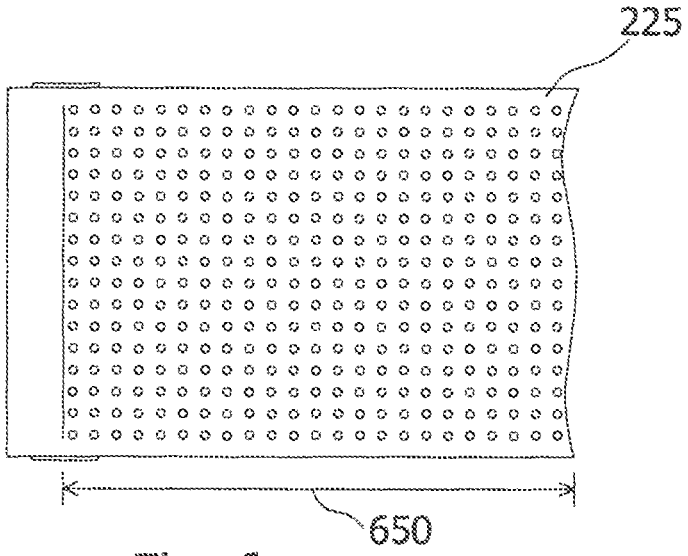
FIG. 6 comprises a side view of stretch film dispensed from a roll of stretch film using a stretch film dispenser configured in accordance with various embodiments of the invention.
Figure 7:
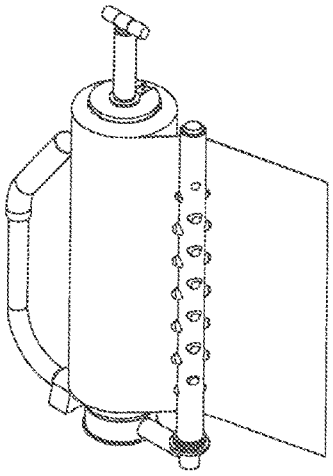
FIG. 7 comprises a perspective view of another example stretch film dispenser as configured in accordance with various embodiments of the invention.
Figure 9:
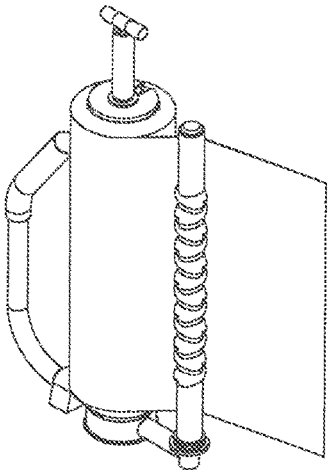
FIG. 9 comprises a perspective view of another example stretch film dispenser as configured in accordance with various embodiments of the invention.
Figure 8:
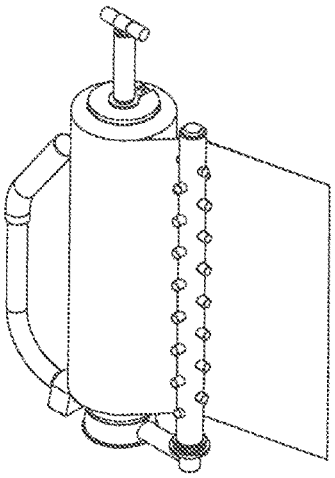
FIG. 8 comprises a perspective view of another example stretch film dispenser as configured in accordance with various embodiments of the invention.
Figure 10:
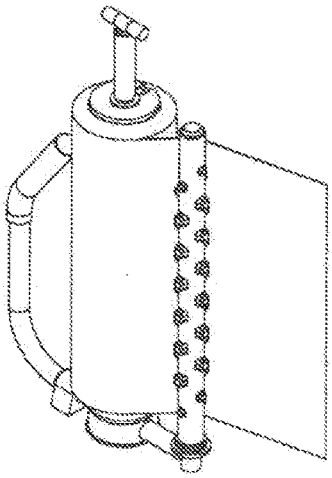
FIG. 10 comprises a perspective view of another example stretch film dispenser as configured in accordance with various embodiments of the invention.

In operation, the dispensing apparatus 200 performs a method for applying a stretch film to an object including engaging the stretch film 225 being dispensed from the dispenser 200 with the at least one member 230 having protrusions 233 to variably stretch the stretch film 225 along a length of the stretch film 225 engaging the at least one member 230. Maintaining tension on the stretch film 225 during engagement with the at least one member 230 effects additional stretch on the stretch film 225 before application to an object. For example, as shown in FIGS. 5 and 6, stretch film 125 dispensed from a stretch film dispenser such as that illustrated in FIG. 1 will have a stretched length 550 of a given amount with the length being defined from a point of engagement 570 with the rotatable member 130 to an end portion of the stretch film 125. FIG. 6 illustrates a same amount of stretch film 225 dispensed from a dispenser like that illustrated in FIGS. 2-4 having a tension similar to that of the stretch film dispensed as illustrated in FIG. 5. The stretch of the stretch film 225 illustrated in FIG. 3 at 650, illustrates that the additional stretching of the stretch film through engagement with the protrusions 233 in combination with the tension applied during application allows the stretch film 225 to stretch out up to at least 15% more as compared to using a prior stretch film application device.

Figure 3:
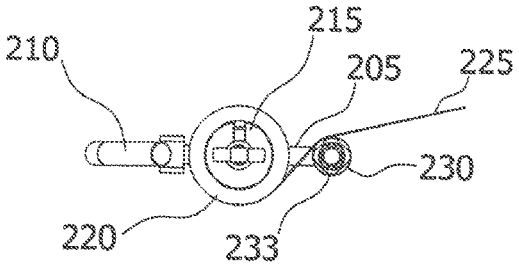
FIG. 3 comprises a top view of the example stretch film dispenser of FIG. 2.

Generally speaking, when the protrusions 233 engage the stretch film 225, the protrusions locally stretch a portion of the stretch film 225 transverse to the plane of the stretch film 225. In contrast to the stretching of the film that is entirely in the plane of the stretch film 225 such as when the stretch film is applied using a dispenser like that of FIG. 1, stretch film being applied using a device such as that of FIGS. 2-4 is additionally stretched in the transverse direction. This transverse action bi-axially orients the film to improve its strength and increasing its area of coverage. The extra stretch in the transverse direction in turn produces an additional stretch in the length of the stretch film 225 when a tension is provided laterally on the stretch film 225.

FIGS. 7-10 illustrate additional examples of the types of protrusions and/or patterns of protrusions that can be used to provide a transverse stretching of the stretch film as it is being dispensed from a roll. As illustrated, the protrusions can come in any of a variety of shapes and sizes designed to effect a stretch and/or piercings in the stretch film transverse to the plane of the stretch film. The examples of FIGS. 7-10 can be modified in a variety of ways to effect such stretching. For example, the protrusions may come in regular or irregular patterns.

Figure 12:
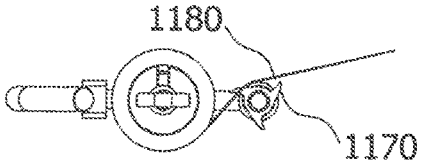
FIG. 12 comprises a top view of the example stretch film dispenser of FIG. 11.
Figure 11:
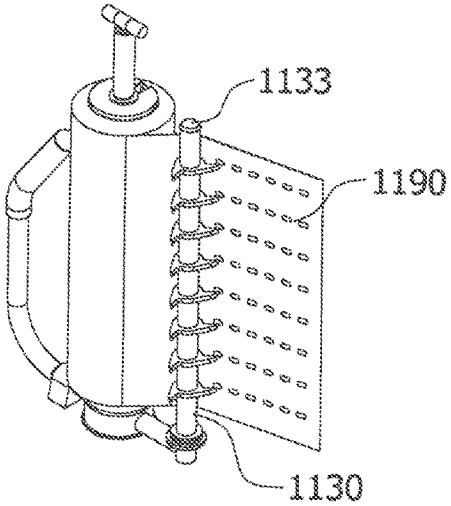
FIG. 11 comprises a perspective view of an example stretch film dispenser that can pierce a film as configured in accordance with various embodiments of the invention.
Figure 13:
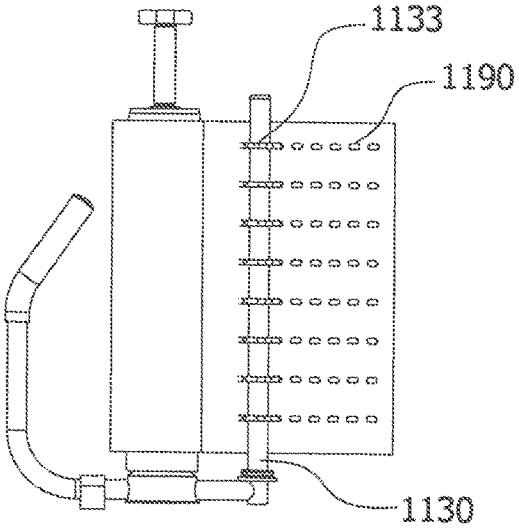
FIG. 13 comprises a side view of the example stretch film dispenser of FIG. 11.

FIGS. 11-13 illustrate another example type of protrusion array designed to pierce the stretch film as it is dispensed from a roll. In this example, the protrusion 1133 includes a leading, curved edge 1170 that initially engages and stretches the film as it engages the member 1130. As the film progresses past the rotating member 1130, the protrusion 1133 rotates further into the film until a pointed end 1180 of the protrusion 1133 pokes through the tensioned film to create a piercing 1190. So configured, an array of piercings 1190 are created in the film while at the same time the film is stretched as described above. In this approach, the benefits of stretching the film are achieved together with providing a way to allow air circulation through the film after it is applied to an object. One skilled in the art will recognize that other particular shapes of protrusions can be used to pierce the film. Moreover, combinations of different types of protrusions can be used on a single member for engaging the film. For instance, one set of protrusions may be designed to pierce the film, and a second set of protrusions can be designed to only stretch the film so that the processed film includes both stretched portions and pierced portions.

Figure 16:
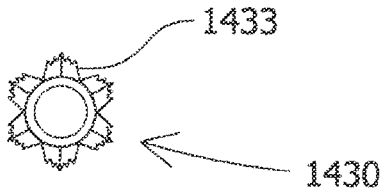
FIG. 16 comprises a top view of the example member of FIG. 14.
Figure 15:
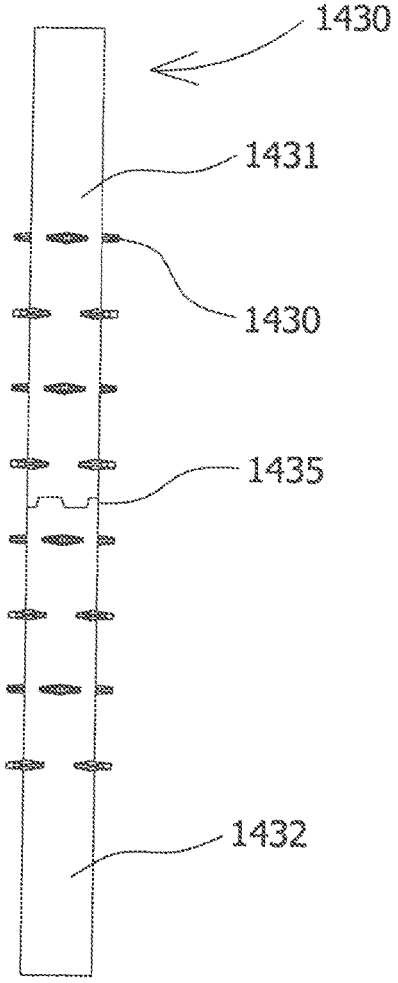
FIG. 15 comprises a side view of the example member of FIG. 14.
Figure 14:
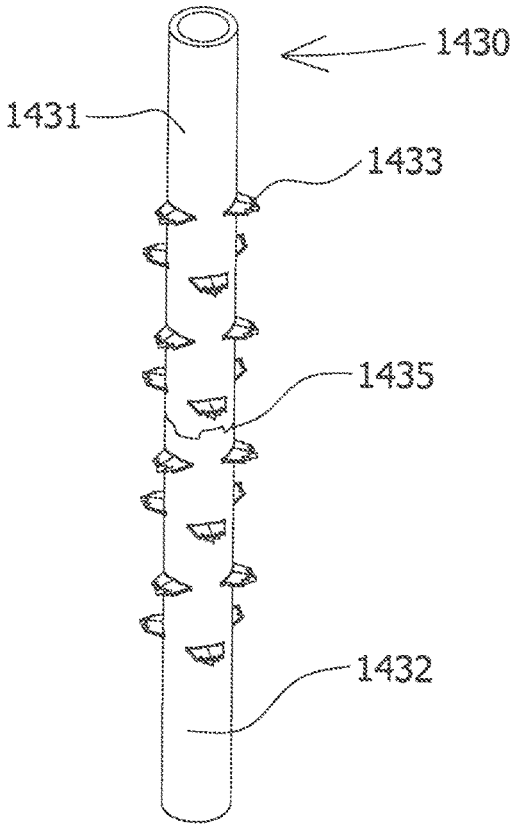
FIG. 14 comprises a perspective view of an example rotatable member with projections as configured in accordance with various embodiments of the invention.

For example, FIGS. 14-16 illustrate another example type of protrusion designed to pierce the stretch film. In this example, the rotatable member 1430 includes two pieces 1431 and 1432 mated together along a seam 1435. The protrusions 1433 include a jagged edge designed to pierce the stretch film when the film engages the protrusions 1433. Such a design does not stretch the film as much as other protrusion designs before piercing the film. Many such designs are possible for the protrusions.

Figure 18:
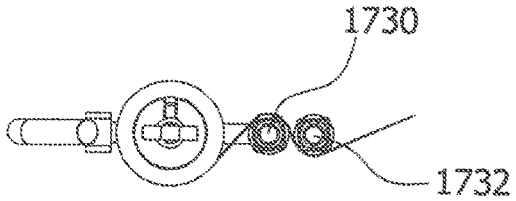
FIG. 18 comprises a top view of the example stretch film dispenser of FIG. 17.
Figure 17:
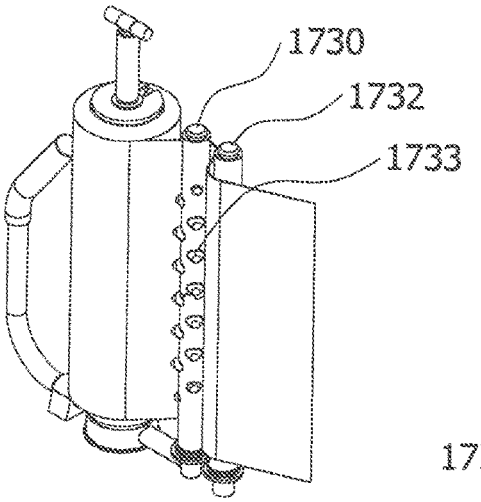
FIG. 17 comprises a perspective view of an example stretch film dispenser having two members engaging the film as configured in accordance with various embodiments of the invention.
Figure 19:
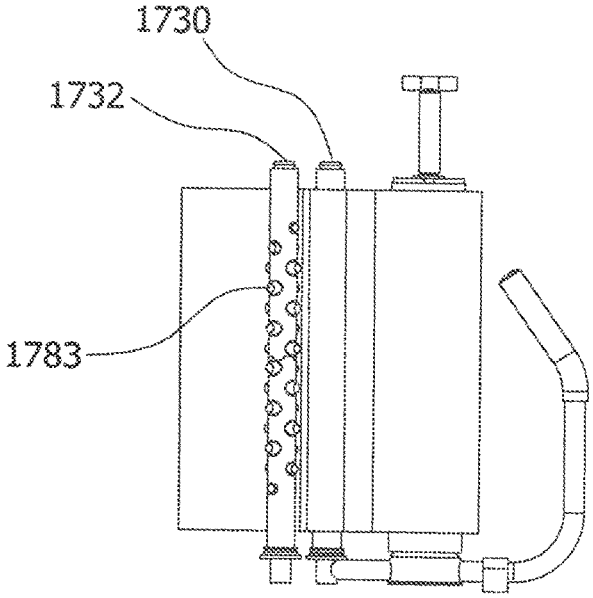
FIG. 19 comprises a side view of the example stretch film dispenser of FIG. 17.

Moreover, additional members including protrusions may be used to engage the stretch film as it is dispensed from the dispenser. For example, a second roller having protrusions may be placed along the stretch film's path extending from the dispenser before engaging the object. FIGS. 17-19 illustrate one such example approach to having two rollers or members engaging the film. The first roller 1730 includes protrusions 1733 to engage the film as the film separates off of its roll to stretch or pierce the film as described above. The second roller 1732 is disposed in the film's path to provide additional stretch in the film's length and to stabilize the film's width to provide additional protection against necking of the film. The second roller may or may not include protrusions. In one such approach shown in FIG. 19, the second roller 1732 includes protrusions 1783 designed to engage the stretch wrap in a pattern to largely not overlap with portions of the stretch film that engage protrusions of a first member engaging the stretch film. Other combinations of protrusions between two or more rollers designed to engage the stretch film are possible.

Figure 20:
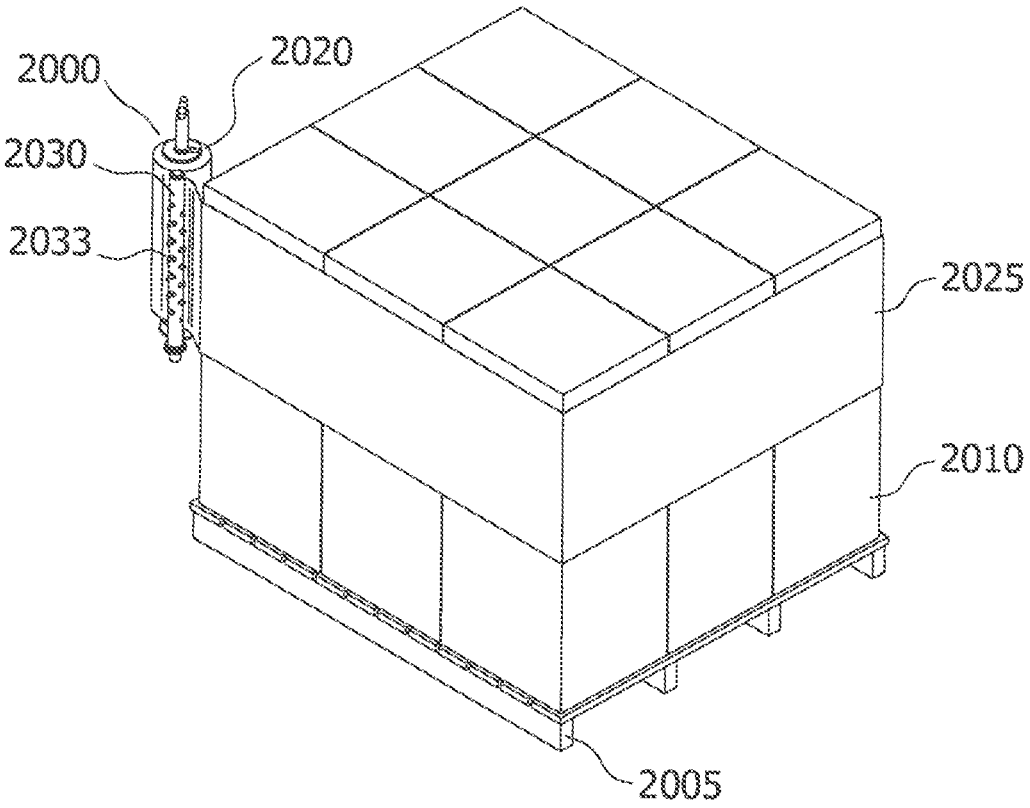
FIG. 20 comprises a perspective view of a pallet with objects being wrapped with stretch wrap using an example stretch wrap dispenser configured in accordance with various embodiments of the invention.

An example application for dispensing stretch film from a stretch film dispenser such as accordingly to the teachings of this disclosure is shown in FIG. 20. The pallet 2005 supports a plurality of boxes 2010 for shipping. After an end of the stretch film is secured to the boxes 2010, a person holds and pulls the frame of the dispenser 2000 along the surface of the boxes 2010, effectively pulling the film 2025 from the roll 2020 over the idler roller 2030. The dispenser 2000 continues to pull the stretch film 2025 around the boxes 2010 to wrap and bind the boxes 2010 together for stability during shipping. The dispenser 2000 includes an idler roller 2030 having protrusions 2033 configured to engage the stretch film 2025 and stretch it along its length through application of tension and in a direction transverse to the length of the stretch film 2025 through engagement of the protrusions 2033 on the stretch film 2025. So configured, the stretch film 2025 exhibits an improved stretch and can cover more of the boxes using less stretch film 2025 from the roll 2020. Thus, less stretch film 2025 is needed to securely wrap the boxes 2010 on the pallet 2005.

Figure 21:
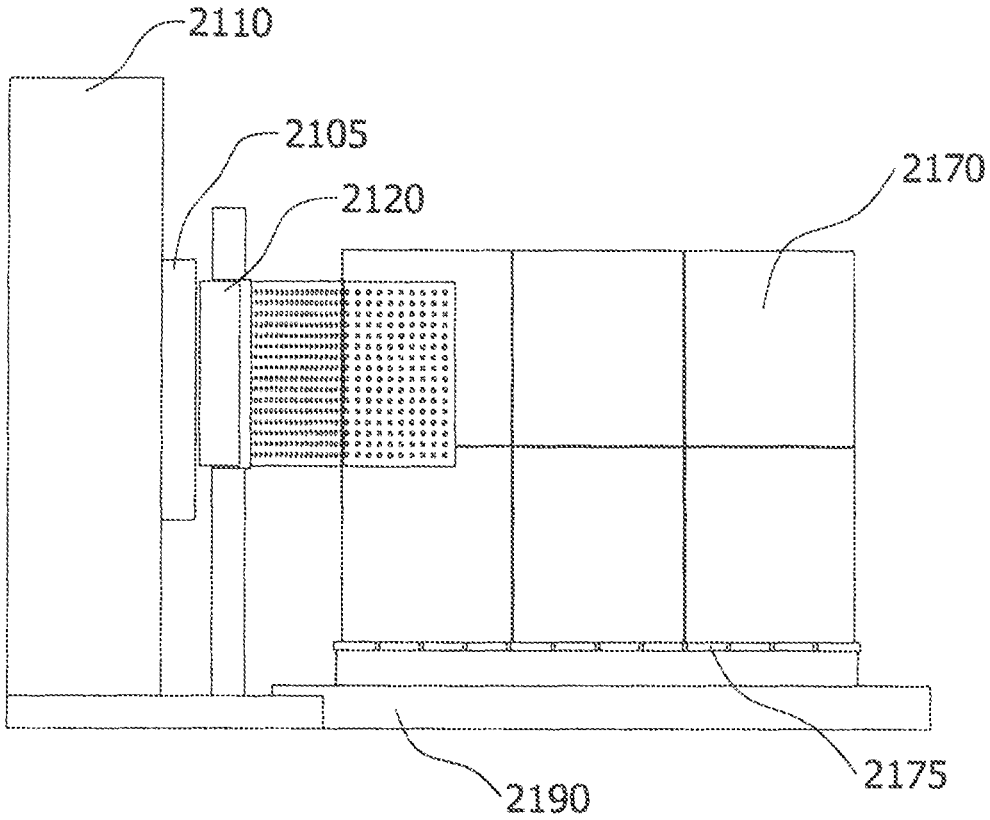
FIG. 21 comprises a perspective view of a pallet with objects being wrapped with stretch wrap using an example stretch wrap dispenser configured in accordance with various embodiments of the invention.

Another application is illustrated in FIG. 21 where the roll 2120 of stretch film is mounted to a frame 2105 supported by a larger apparatus 2110. In this case the larger apparatus 2110 is configured to move the roll 2120 up and down relative to the boxes 2170 stacked on a pallet 2175. The apparatus 2110 cooperates with a rotation mechanism 2190 configured to rotate the pallet 2175. After an end of the stretch film is secured to the boxes 2170, the rotation of the pallet 2175 pulls the stretch film from the roll 2120. A roller with protrusions is disposed next to the roll 2120 to engage the tensioned stretch film as it leaves the roll 2120 and before it engages the boxes 2170. Such an auto-wrapping device is known in the art and needs no further explanation. The apparatus 2110 can be modified to include a mechanism to modify the tension on the stretch film as it is applied the boxes 2170.

Figure 22:
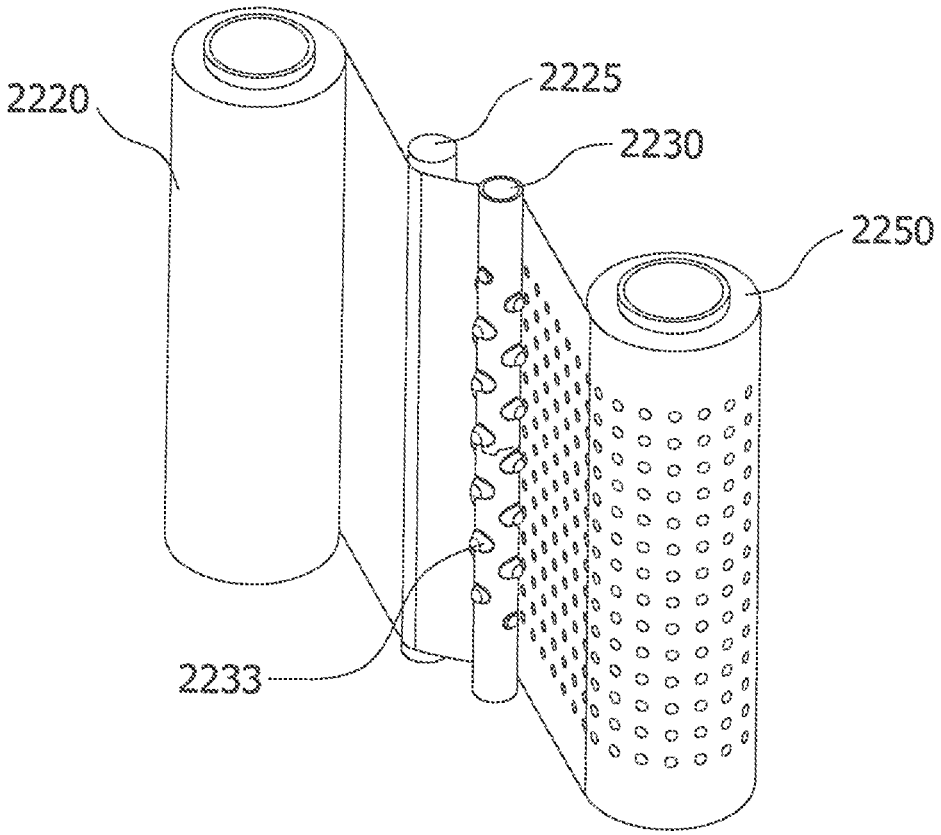
FIG. 22 comprises a perspective view of a partial apparatus for pre-stretching and re-rolling a stretch film in accordance with various embodiments of the invention.

Another example application of this subject matter is in applying the protrusions to bi-axially stretch the stretch film during the stretch film's preparation and prior to its being rolled onto a roll for dispensing. In one example of this approach, one or more members like that described above can be disposed to engage stretch film just before the stretch film is rolled up. One such example is illustrated in FIG. 22. In the illustrated example, stretch film is unrolled from a first roll 2220 over a first roller 2225 that stretches the film along its length. A second roller 2230 then engages the film with protrusions 2233 to stretch the film locally and transverse to the plane of the stretch film. Optionally, the stretch film can be pierced in addition to or instead of being stretched by the protrusions. The stretched film is then re-rolled onto a second roll 2250 for storage for later use. Mechanisms can be built to support the rolls 2220 and 2250 and rotate them to effect the stretch film's engagement of the rollers 2225 and 2230. The roller 2225 and 2230 may have any combination of protrusions or not, depending on the type of stretch or piercing desired for a given pre-stretched film. Such pre-stretched stretch film can then be applied using a prior applicator such as that of FIG. 1 while maintaining much of the advantageous described above.

Figure 23:
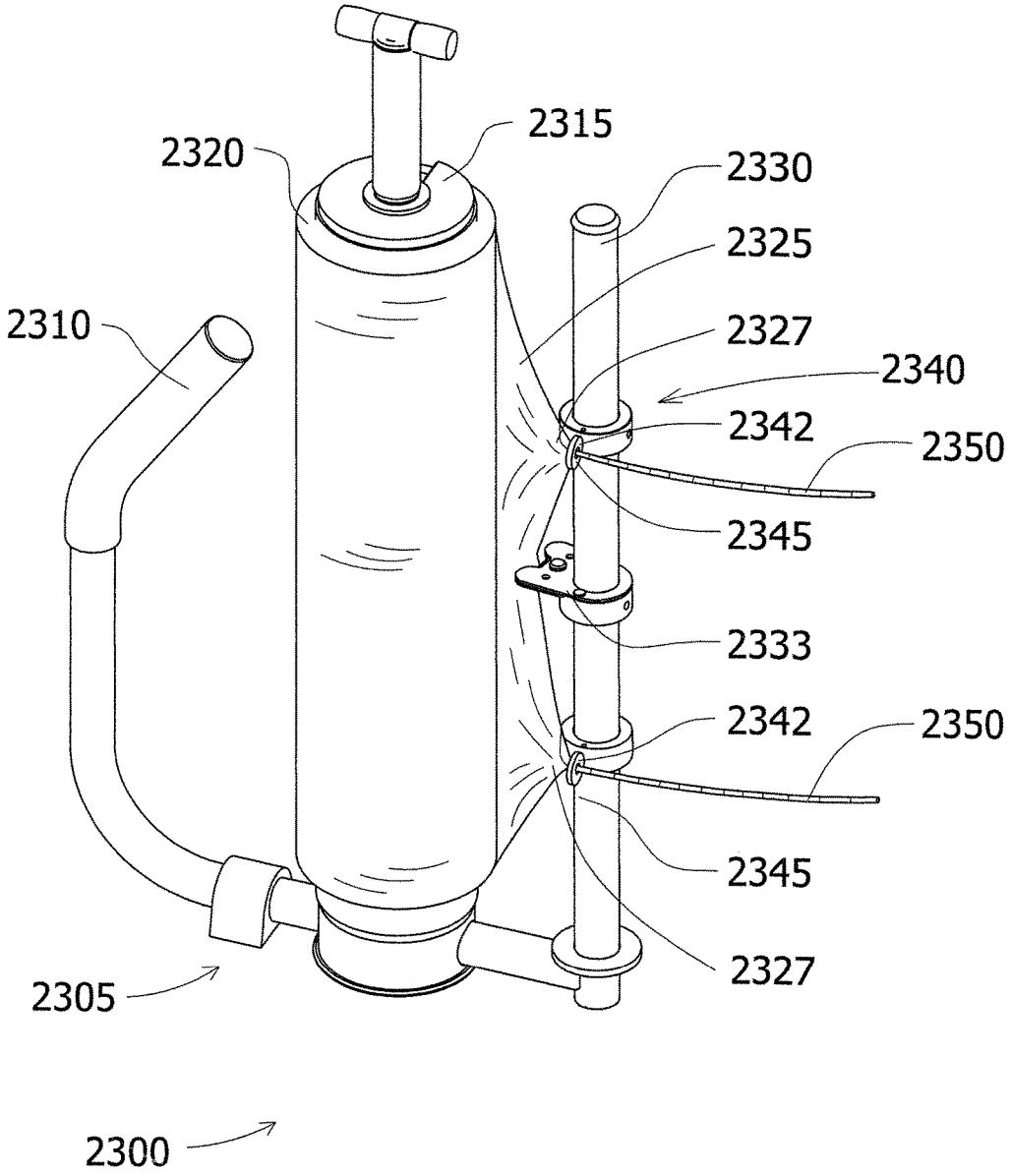
FIG. 23 comprises a perspective view of an example stretch film dispenser having a cutting device and gathering devices forming the film into strings as configured in accordance with various embodiments of the invention.
Figure 24:
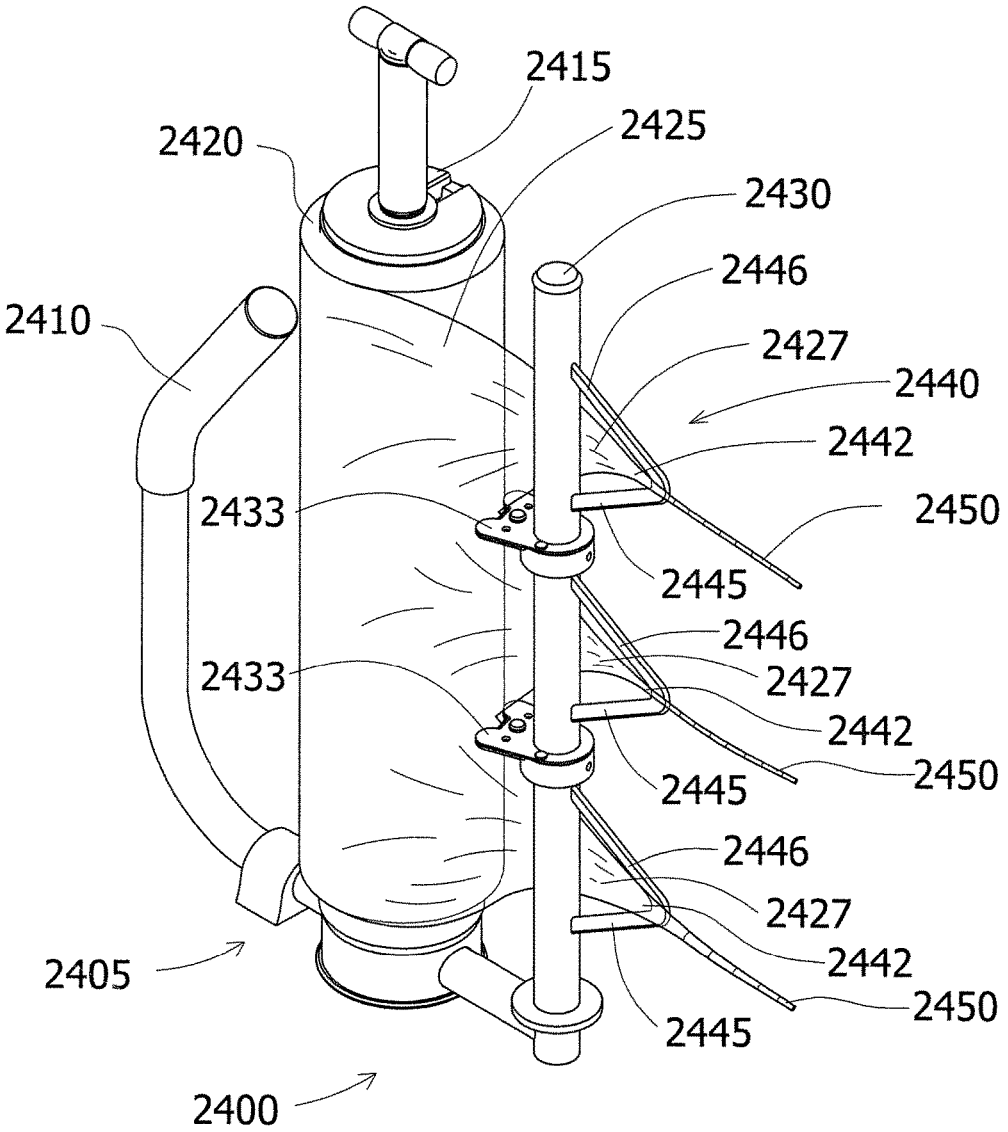
FIG. 24 comprises a perspective view of an example stretch film dispenser having two cutting devices and three gathering devices forming the film into strings as configured in accordance with various embodiments of the invention.
Figure 25:
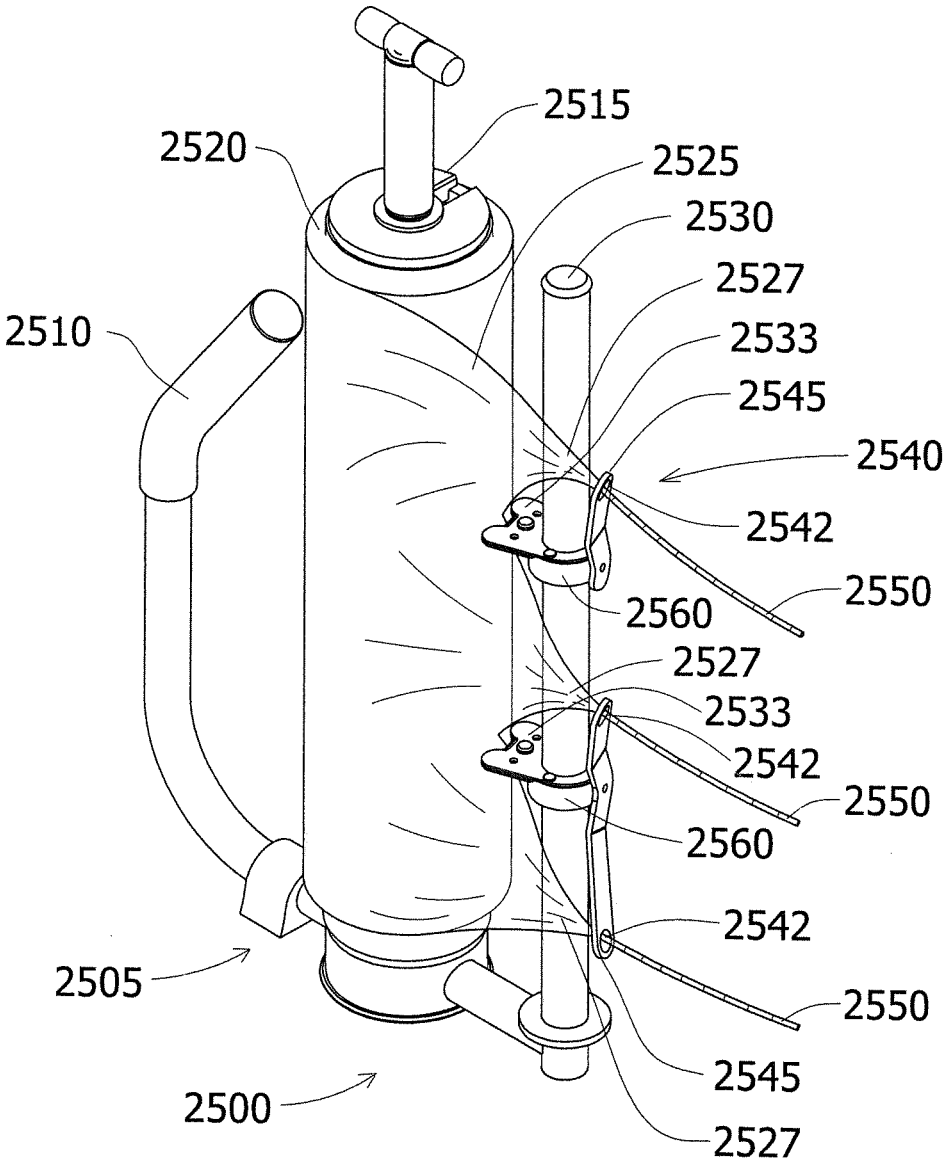
FIG. 25 comprises a perspective view of another example stretch film dispenser having two cutting devices and three gathering devices forming the film into strings as configured in accordance with various embodiments of the invention.

In another approach, instead of merely stretching or piercing the stretch wrap, the stretch wrap is cut into strips, which are stretched and gathered into strings that are used to wrap and secure the object. Three such examples are illustrated in FIGS. 23, 24, and 25. In each, an apparatus 2300, 2400, 2500 for applying a stretch film to an object includes a support frame 2305, 2405, 2505 including an extension handle 2310, 2410, 2510 that facilitates manual application of stretch film to an object. The frame 2305, 2405, 2510 can be made of any suitable material such as a metal such as steel or plastic having sufficient strength to support the various aspects of the stretch film dispenser 2300, 2400, 2500 against the forces experienced during stretch film application. One of skill in the art will recognize that the teachings of this disclosure are not limited to hand application of stretch film and may be applied to mechanical or automatic application (in-line application) of stretch wrap or film to objects, such as that illustrated in FIG. 21. A support 2315, 2415, 2515 is configured to support a roll 2320, 2420, 2520 of stretch film 2325, 2425, 2525 and dispense the stretch film 2325, 2425, 2525 in response to tension on the stretch film 2325, 2425, 2525. The support 2315, 2415, 2515 may be a rotatable arm or an elongated element designed to engage a hollow center of a stretch film roll, gripping members designed to engage either end of a stretch film roll, or other design suitable to support a roll of stretch film for dispensing.

A support member 2330, 2430, 2530 extending approximately parallel (being sufficiently in line to facilitate the cutting and gathering operations along the width of the stretch wrap) to the support 2315, 2415, 2515 to be along a path between the stretch film 2325, 2425, 2525 dispensed from the stretch roll 2320, 2420, 2520 and the object. By one approach, the extension handle 2310, 2410, 2510 is disposed opposite of the support member 2330, 2430, 2530 to facilitate manual operation and control of the stretch wrap as it is applied to the object. At least one cutting member 2333, 2433, 2533 is supported by the support member 2330, 2430, 2530 and relative to the stretch film 2325, 2425, 2525 to cut the stretch film 2325, 2425, 2525 into at least two strips 2327, 2427, 2527 upon removal from the roll 2320, 2420, 2520. At least two gathering devices 2340, 2440, 2540 are disposed to stretch and gather individual ones of the at least two strips 2327, 2427, 2527 of stretch film 2325, 2425, 2525 into strings 2350, 2450, 2550 configured to wrap around the object. The gathering devices engage, gather, and provide and maintain tension on the stretch film 2325, 2425, 2525 after the stretch film 2325, 2425, 2525 engages the gathering devices to effect additional stretch and gathering of the stretch film 2325, 2425, 2525 into the elongated strings 2350, 2450, 2550 that are applied to the object.

So configured, the dispenser is able to cut, stretch, and gather the stretch film into stretched strings having a significant tensile strength while also being stretched out enough to effect a savings in the amount of stretch wrap used to wrap and secure a particular object. Such approaches can be advantageous for certain loads that need some air circulation and thus cannot withstand being fully sealed by the stretch film. FIGS. 23, 24, and 25 illustrate three particular examples of such dispensers although details of these examples may be modified while still being within this inventive concept.

In the example of FIG. 23, individual ones of the at least two gathering devices 2340 define apertures 2342 disposed to direct the strips 2327 away from the stretch roll 2320 and toward the object. The gathering devices 2340 may be rigid rings or washers 2345 secured to the support member 2330. The inner round (although other shapes are possible) apertures 2342 of the rings or washers 2345 engage, gather, and provide and maintain tension on the stretch film 2325 as the strips 2327 pass through the apertures 2342 while moving toward the object to effect additional stretch and gathering of the stretch film 2325 into the elongated strings 2350 that are applied to the object. The inner apertures 2342 may comprise or be coated in a variety of materials to effect different stretching forces on engaging the stretch wrap. In other approaches, the gathering devices may be slots defined to selectively engage and gather the stretch film 2325 into strings or ropes, with the slots allowing the stretch film 2325 to be released from the gathering devices to stop the gathering of the material into strings or ropes.

In the example of FIG. 24, individual ones of the at least two gathering devices 2440 include two members 2445 and 2446 supported by the support member 2430 and intersecting in a direction away from the support 2405 configured to support the roll 2420. The two members 2445 and 2446 and support member 2430 define an aperture 2442 disposed to direct one of the strips 2427 away from the roll 2420 and toward the object. The two members 2445 and 2446 may be two distinct members that are mechanically connected together to define the aperture 2442 with the support 2430 or, in another approach, the two members 2445 and 2446 may be separate legs of a single angled member that is mounted to the support 2430 to define the aperture 2442.

In the example of FIG. 25, individual ones of the at least one of the gathering members 2550 comprises a rigid member 2545 mounted to the support member 2530. The rigid member 2545 has a distal end extending away from the support 2530 and defining an aperture 2542. The aperture 2542 is configured to receive, gather, and stretch one of the strips 2527 into one of the strings 2550 as the strips 2527 pass through the apertures 2542 while moving toward the object. In one approach, the dispenser 2550 also includes a mount 2560 configured to mount to the support member 2530 and to support at least one of the cutting members 2533 and at least one of the rigid members 2545. In this example the rigid members 2545 made comprise any of a variety of materials having different flexibilities such that the rigid members 2545 may have some flex during the stretching and dispensing of the stretch film, but not so much flex that the rigid members 2545 are unable to direct the strings 2550 toward the object being secured. As with the above examples, the inner aperture 2542 may comprise or be coated in a variety of materials to effect different stretching forces on engaging the stretch wrap as it moves through the aperture 2542. In still another approach, the gathering devices can be mounted so as to be rotatable to allow a user to selectively engage the gathering devices mid-stream (during continuous dispensing of the stretch film) to apply un-gathered stretch film or gathered strings to a load.

Figure 26:
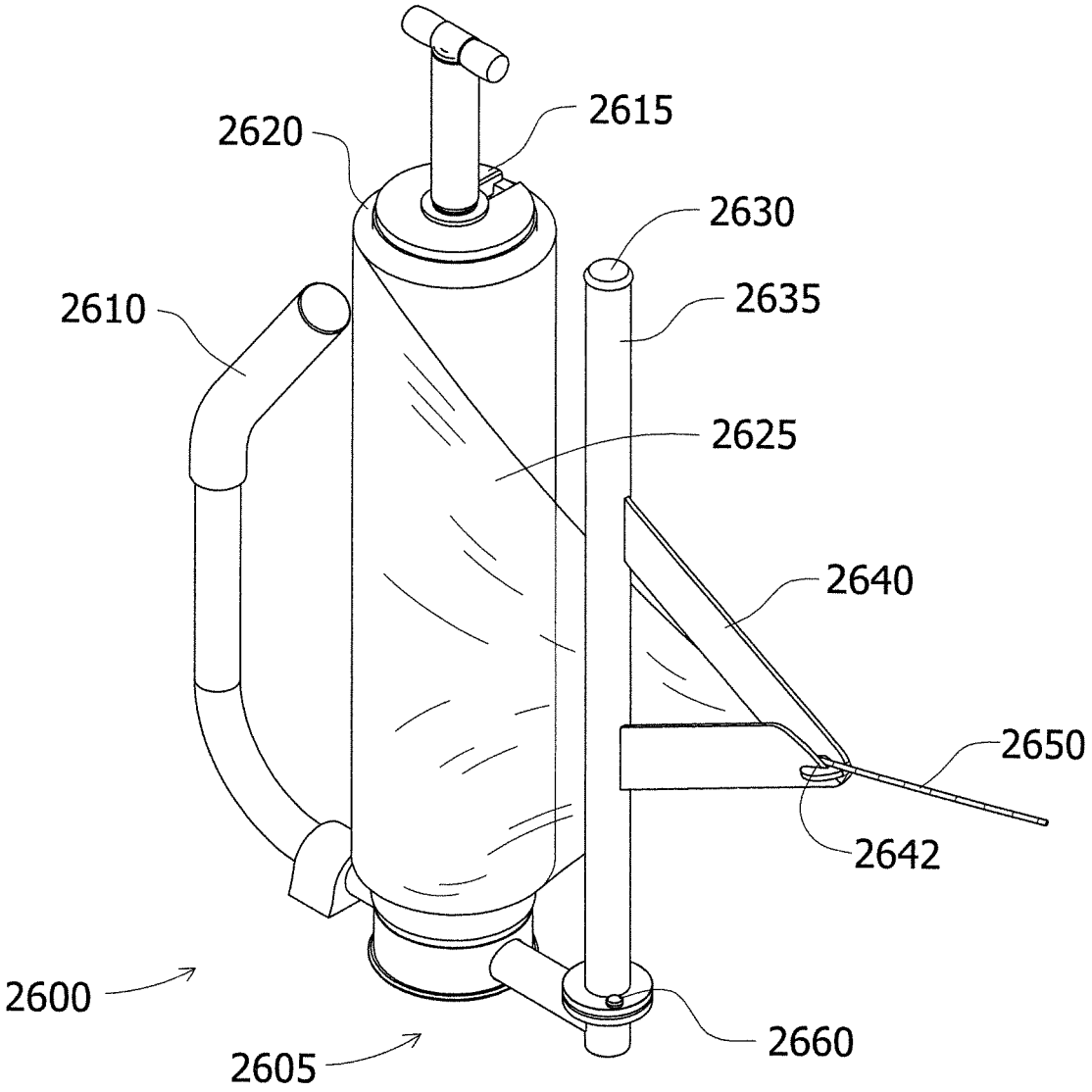
FIG. 26 comprises a perspective view of an example stretch film dispenser having a gathering device forming the film into a string or rope without cutting the film as configured in accordance with various embodiments of the invention.
Figure 27:
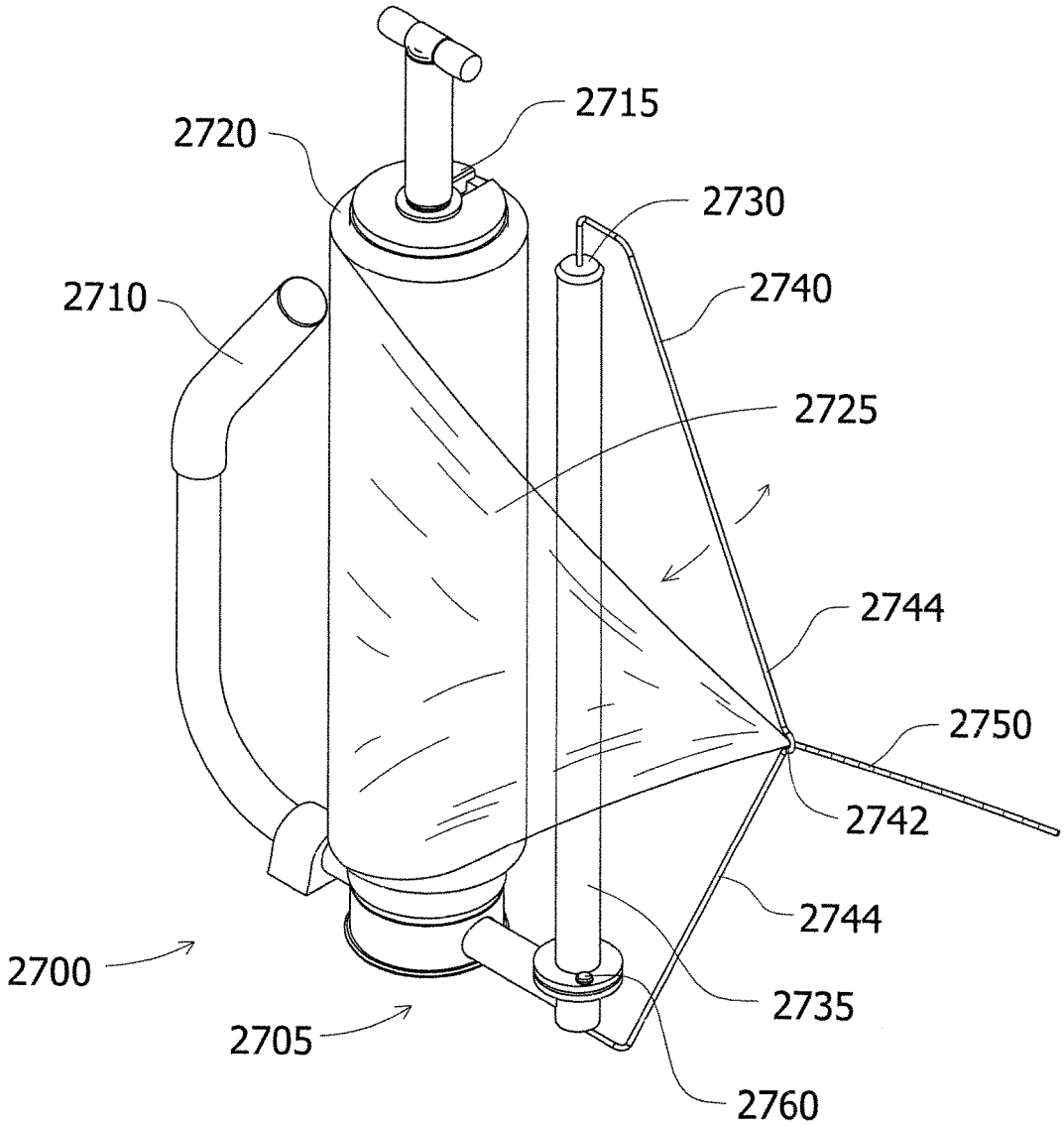
FIG. 27 comprises a perspective view of another example stretch film dispenser having a gathering device forming the film into a string or rope without cutting the film as configured in accordance with various embodiments of the invention.
Figure 28:
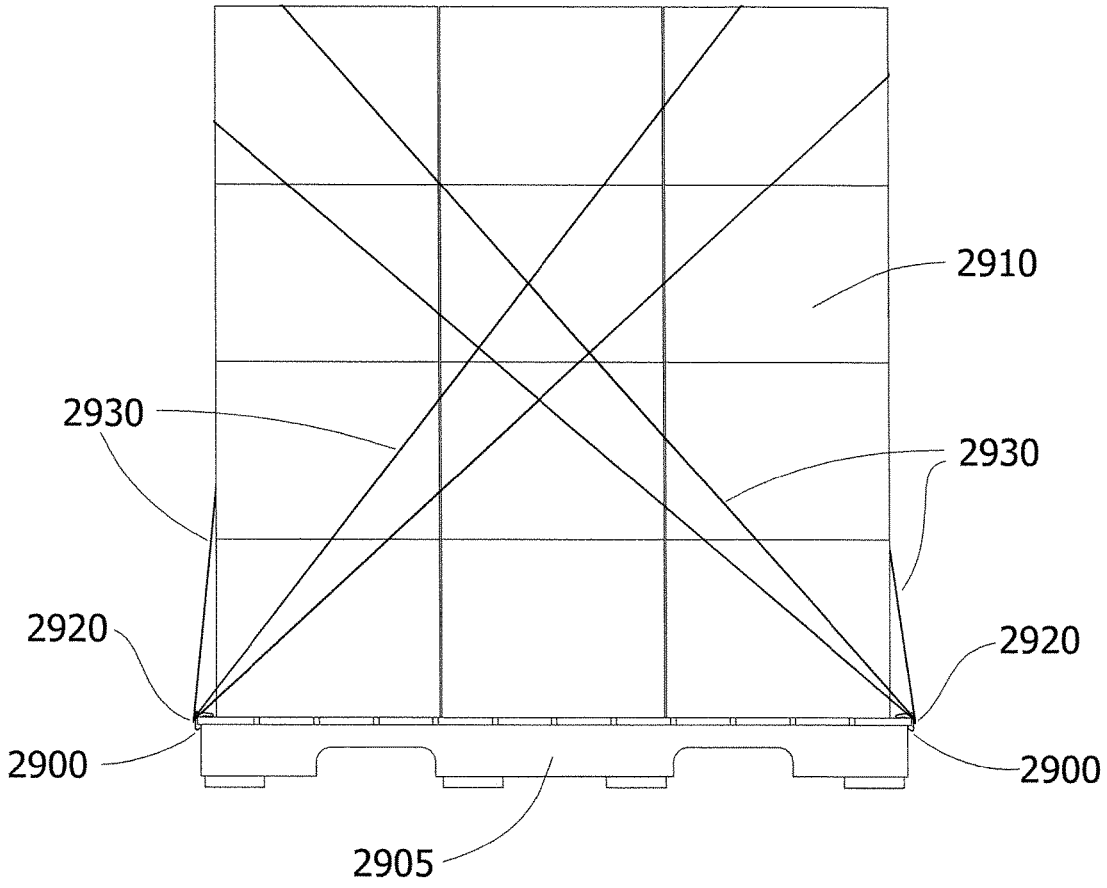
FIGS. 28 and 29 comprise side and perspective views of loads secured to pallets using rope or string material secured with an attachment apparatus as configured in accordance with various embodiments of the invention.

In yet another approach, instead of cutting the stretch wrap is cut into strips before gathering the strips into strings used to wrap and secure the object, the entirety of the stretch wrap can be stretched and gathered into one string or rope used to secure a load. Two such examples are illustrated in FIGS. 26 and 27. In both, an apparatus 2600, 2700 for applying a stretch film to an object includes a support frame 2605, 2705 including an extension handle 2610, 2710 that facilitates manual application of stretch film to an object. The frame 2605, 2705 can be made of any suitable material such as a metal such as steel or plastic having sufficient strength to support the various aspects of the stretch film dispenser 2600, 2700 against the forces experienced during stretch film application. One of skill in the art will recognize that the teachings of this disclosure are not limited to hand application of stretch film and may be applied to mechanical or automatic application (in-line application) of stretch wrap or film to objects, such as that illustrated in FIG. 21. A support 2615, 2715 is configured to support a roll 2620, 2720 of stretch film 2625, 2725 and dispense the stretch film 2625, 2725 in response to tension on the stretch film 2625, 2725. The support 2615, 2715 may be a rotatable arm or an elongated element designed to engage a hollow center of a stretch film roll, gripping members designed to engage either end of a stretch film roll, or other design suitable to support a roll of stretch film for dispensing.

A support member 2630, 2730 extending approximately parallel (being sufficiently in line to facilitate engaging the stretch wrap to stretch it and guide it to a gathering device) to the support 2615, 2715 to be along a path between the stretch film 2625, 2725 dispensed from the stretch roll 2620, 2720 and the object. By one approach, the extension handle 2610, 2710 is disposed opposite of the support member 2630, 2730 to facilitate manual operation and control of the stretch wrap as it is applied to the object. A rotatable member 2635, 2735 is supported by the support member 2630, 2730 and relative to the stretch film 2625, 2725 to engage and stretch the stretch film 2625, 2725 as it moves past the rotatable member 2625, 2725. A gathering device 2640, 2740 is disposed to stretch and gather the stretch film 2625, 2725 into a string or rope 2650, 2750 configured to wrap around the object. The gathering devices 2640, 2740 engage, gather, and provide and maintain tension on the stretch film 2625, 2725 after the stretch film 2625, 2725 engages the gathering devices to effect additional stretch and gathering of the stretch film 2625, 2725 into the elongated strings or ropes 2650, 2750 that are applied to the object. In various approaches, the gathering device 2640, 2740 may be mounted so as to be selectively or intermittently movable into engagement with the stretch film 2625, 2725. Thus, in one example, while dispensing stretch film 2625, 2725 from a roll from a manually operated dispenser for immediate application to an object, a gathering device 2640, 2740 intermittently engages the stretch film 2625, 2725 to dispense either the stretch film 2625, 2725 or a string 2650, 2750 created by the gathering device 2640, 2740 when the gathering device 2640, 2740 engages and gathers the stretch film 2625, 2725 during the application to the object.

So configured, the dispenser is able to stretch and gather the entire width of stretch film into one stretched strings or rope having a significant tensile strength while also being stretched out enough to effect a savings in the amount of stretch wrap used to wrap and secure a particular object. Such approaches can be advantageous for certain loads that need some air circulation and thus cannot withstand being fully sealed by the stretch film. Moreover, rope gathered in this manner is more available to be un-gathered back into a flat stretch film for further or reuse. Also, where the gathering device is configured to be movable, a person using such a dispenser is able to selectively apply the gathering device to change on the fly between applying stretched film or string(s), based on the application of the gathering device. FIGS. 26 and 27 illustrate two particular examples of such dispensers although details of these examples may be modified while still being within this inventive concept.

In the example of FIG. 26, the gathering device 2640 defines an aperture 2642 shaped to gather the edges of the stretch film 2625 as it pulls away from the stretch roll 2320 together into the rope 2650 directed toward the object. The gathering device 2640 in this example is rigidly mounted on the rotatable member 2635 to rotate with that member 2635. The rotatable member 2635 can be locked in place to prevent location by a locking mechanism 2660. The locking mechanism 2660 can be any mechanism suitable to prevent rotation of the rotatable member 2635 in view of the loads created during a stretch wrap dispensing and roping operation. Examples include a gear lock, pin, and the like. Using the locking mechanism 2660, the rotatable member 2635 and the gathering device 2640 can be positioned in any angular position relative to the stretch film roll 2620 to facilitate the dispensing and gathering operation for a given application. For instance, the gathering device 2640 and the rotatable member 2635 can be locked in a position such that stretch film 2625 is dispensed without engaging the gathering device 2640 such that the stretch film 2625 is applied to the object without gathering. In another approach, they may be locked in a position to facilitate engagement of the stretch film 2625 by the gathering device 2640. In such a position, the gathering device 2640 engage, gather, and provide and maintain tension on the stretch film 2625 as the stretch film 2625 passes through the aperture 2642 while moving toward the object to effect additional stretch and gathering of the stretch film 2625 into the elongated string or rope 2650 that is applied to the object. The gathering device 2640 may comprise or be coated in a variety of materials to effect different stretching forces on engaging the stretch wrap 2625, such as steel or other material.

In the example of FIG. 27, the gathering device 2740 includes a rounded member extending out from the rotatable member 2735 so as to be rotatable independent from the rotatable member 2735 and the support 2730. For example, the gathering device 2740 here may be an extended thick wire bent into a shape to connect to be rotatably supported by the support 2730 and/or rotatable member 2735. The rounded nature of the gathering device 2740 can facilitate passage of the stretch film 2725 across the device 2740. By one approach, the gathering device 2740 defines a notch 2742 into which the stretch film 2725 is guided by the arms 2744 of the gathering device 2740 to facilitate the "roping" of the stretch film 2725. Because the gathering device 2740 is independently rotatable, a user can readily rotate it to engage or disengage the stretch film 2725 to selectively gather or not gather the stretch film 2725 into a string or rope 2750 during continuous (or in between uses) dispensing of the stretch film 2725 from the roll 2720 to selectively apply stretch film or string/rope to an object. Like the example of FIG. 26, a locking mechanism 2760 may be incorporated to lock down rotation of the rotatable member 2735 and/or the gathering device 2740. So configured, the dispenser 2700 provides further flexibility in how the stretch film is manipulated into a rope or string while applying it to secure a load.

Figure 29:
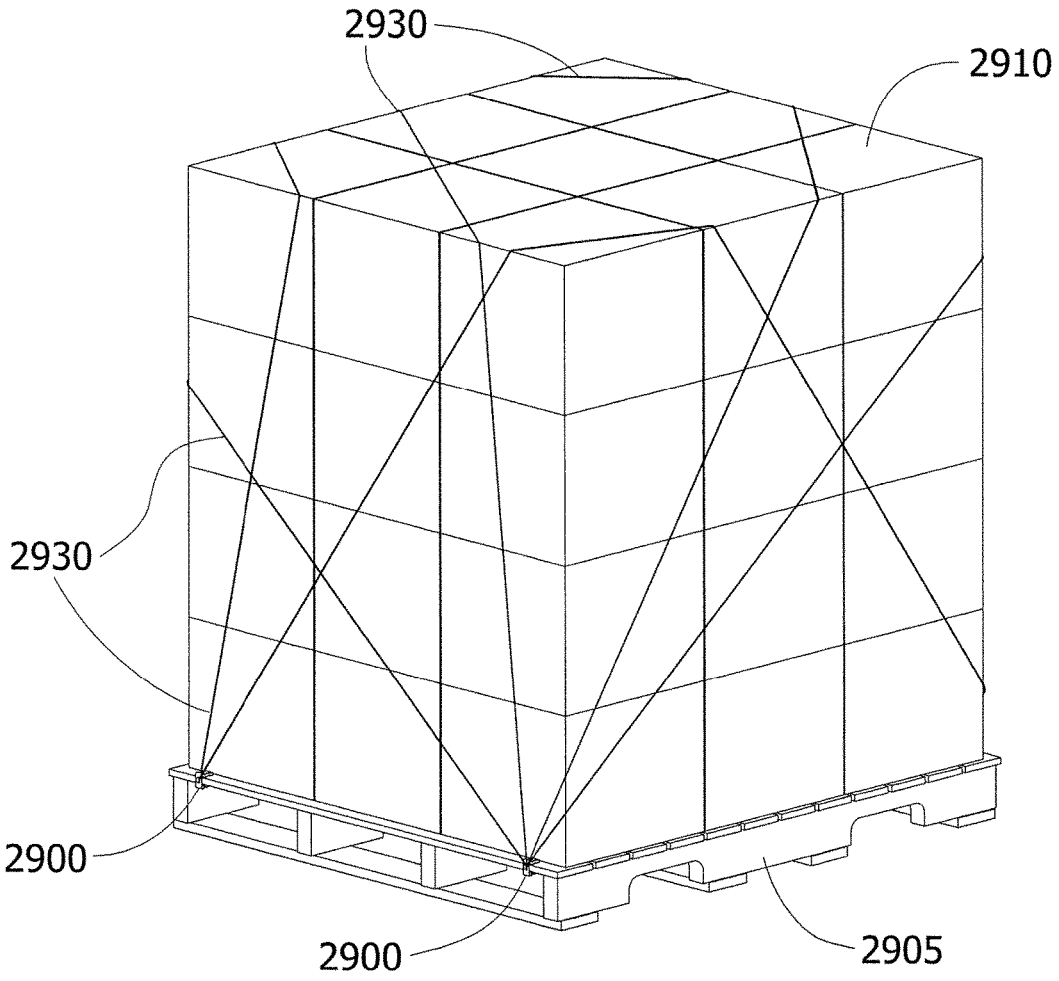

Rope or string, such as the gathered stretch film as discussed above, can be used to secure a load or object to pallet using attachment devices. With reference to FIG. 29, an attachment apparatus 2900 configured to attach to a pallet 2905 configured to support the object or load 2910. The attachment apparatus 2900 defines an engagement surface 2920 configured to engage a rope or string 2930, such as a string of stretch film, to secure it to the pallet 2905. The attachment apparatus 2900 can have a variety of forms and sizes having sufficient strength to grip the pallet and withstand the forces of the string to hold the load to the pallet.

Figure 30:
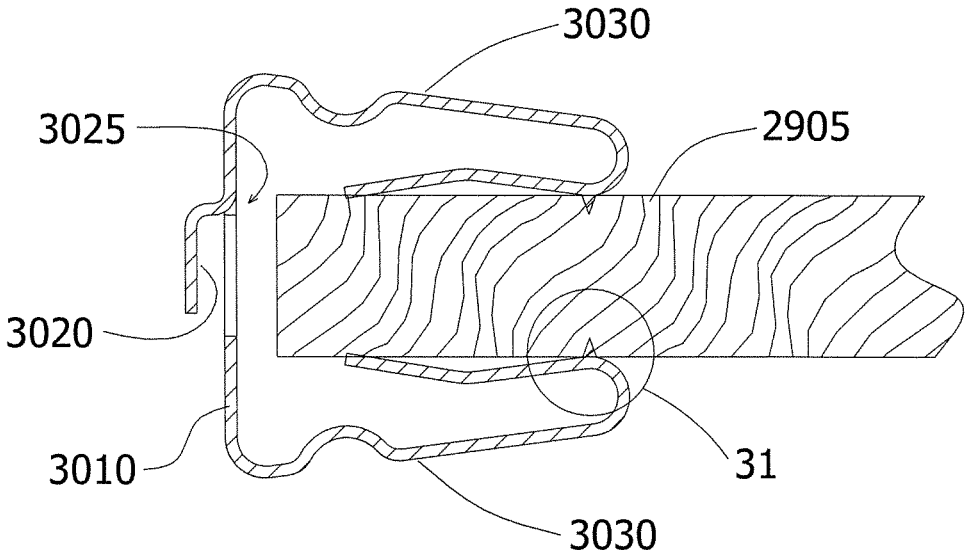
FIG. 30 comprises an elevation view of an example attachment apparatus attached to a portion of a pallet as configured in accordance with various embodiments of the invention.
Figure 31:
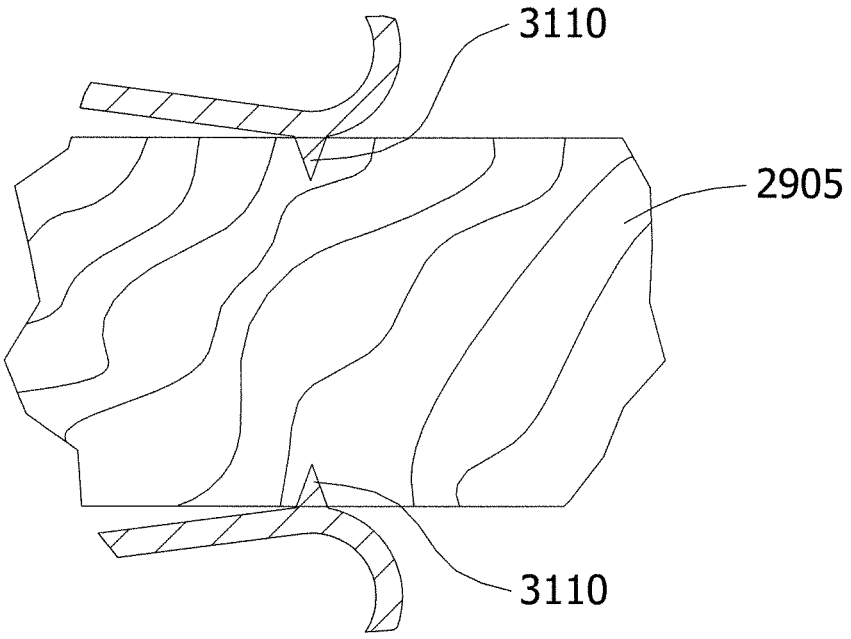
FIG. 31 comprises a zoom in of portion 31 of the attachment apparatus of FIG. 30.

One example attachment apparatus is illustrated in FIG. 30. Here, the attachment apparatus includes a bridge section 3010 and an engagement surface 3020 supported by the bridge section 3010. By one approach, the engagement surface 3020 is the back side of a tab extending from the bridge section 3010. In another approach, the engagement surface can be the back side 3025 of the bridge section 3010. At least two arms 3030 extend from the bridge section 3010. The at least two arms 3030 are biased to pinch a section of the pallet 2905 to secure the apparatus to the pallet 2905. For example, the attachment apparatus may be constructed out of a resilient material like steel or other metal and shaped with a space between the at least two arms 3030 smaller than a typical pallet section to which the device will attach. Thus, the device can spread open, be placed around or slide onto the pallet portion, and grip onto the pallet. In one approach, the attachment apparatus of FIG. 30 can be a single stamped piece of metal, which can cost effective to manufacture. Optionally, as illustrated in FIG. 31, a friction surface 3110 is disposed on individual ones of the at least two arms 3030. The friction surface 3110 is disposed to engage the pallet 2905. The friction surface 3110 can be a grooved or spiked portion of one or more of the arms 3030 that engages the pallet 2905 to provide additional gripping strength.

Figure 32:
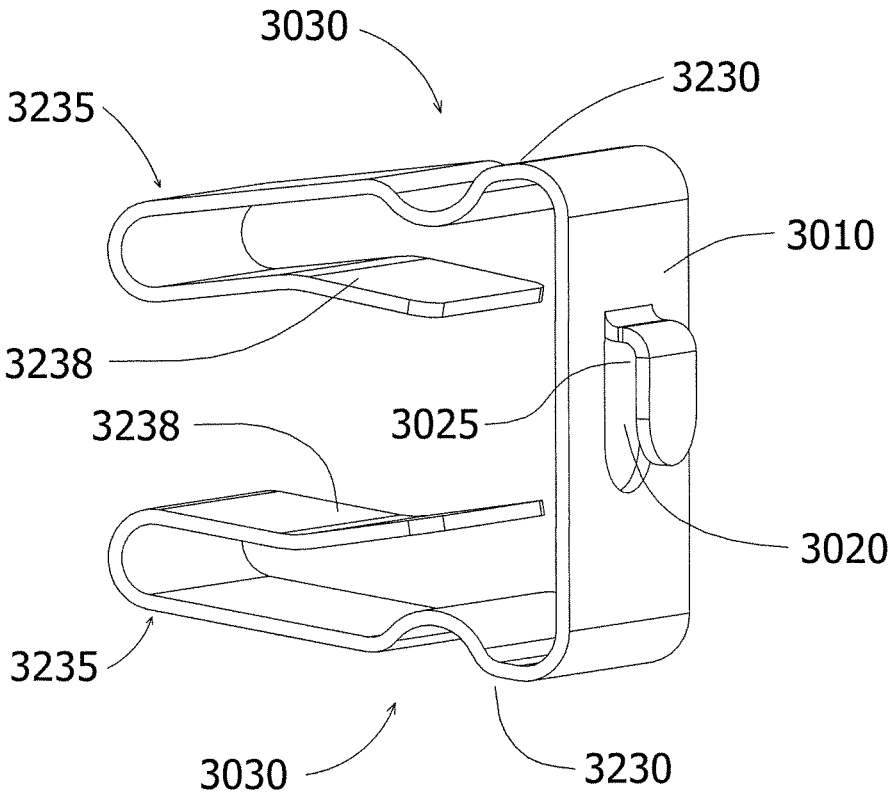
FIG. 32 comprises a perspective view of an example attachment apparatus like that of FIG. 30.

The example attachment device of FIG. 32 illustrates a version where individual ones of the two arms 3030 include a first section 3230 having a distal end 3235 extending away from the bridge section 3010 and a second section 3238 extending from the first section's distal end 3235 and biased inward toward an opposing arm of the at least two arms 3030 to engage the pallet 2905. Friction surfaces 3110 can be provided on any of the surfaces that will engage the pallet. Either or both arms 3030 can have this second portion. Alternatively, the arms 3030 can have only a single portion extending from the bridge section 3010 to engage the pallet 2905.

Figure 33:
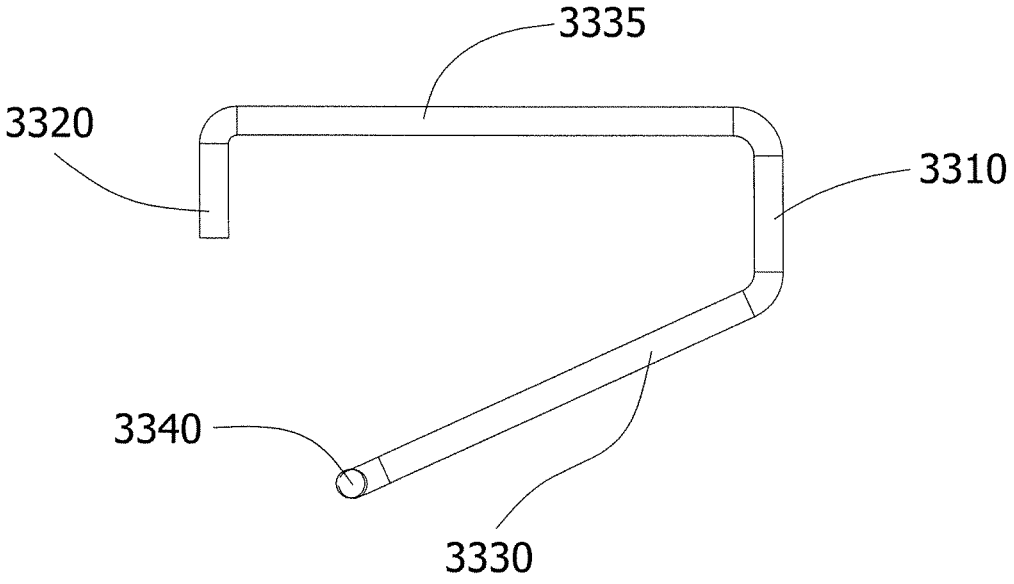
FIG. 33 comprises a side view of an example attachment apparatus attached to a portion of a pallet as configured in accordance with various embodiments of the invention.
Figure 34:
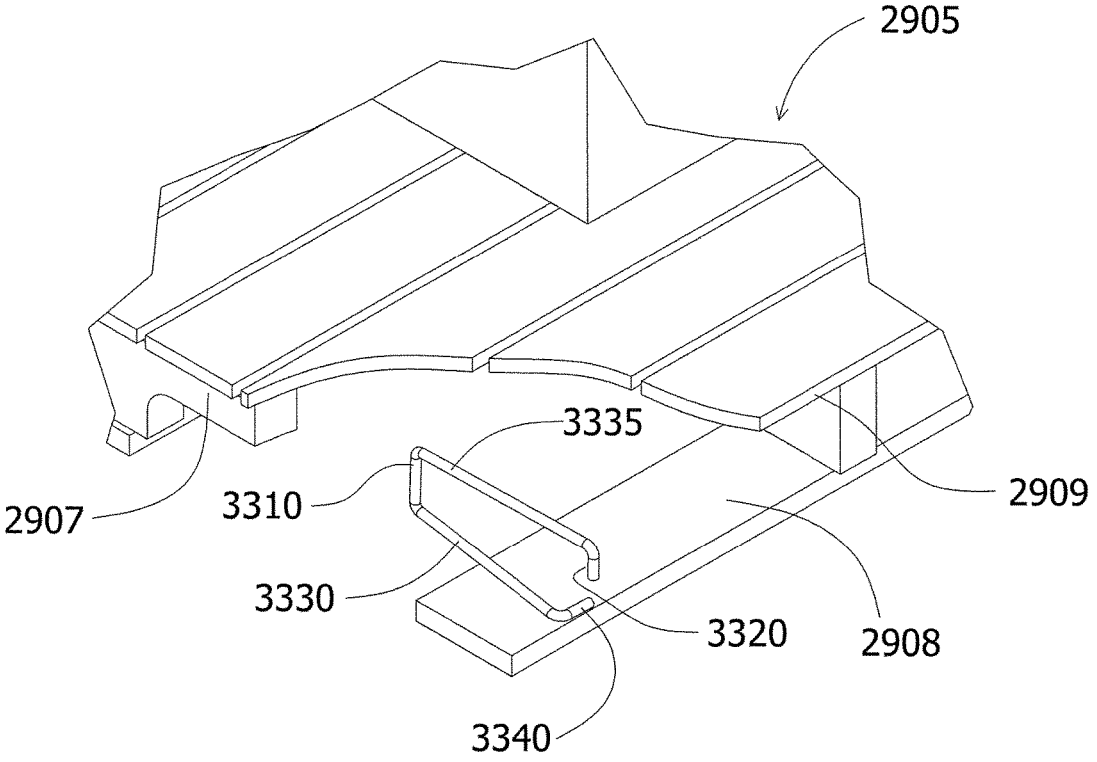
FIG. 34 comprises a perspective view of an example attachment apparatus like that of FIG. 33 disposed in a pallet as configured in accordance with various embodiments of the invention.
Figure 35:
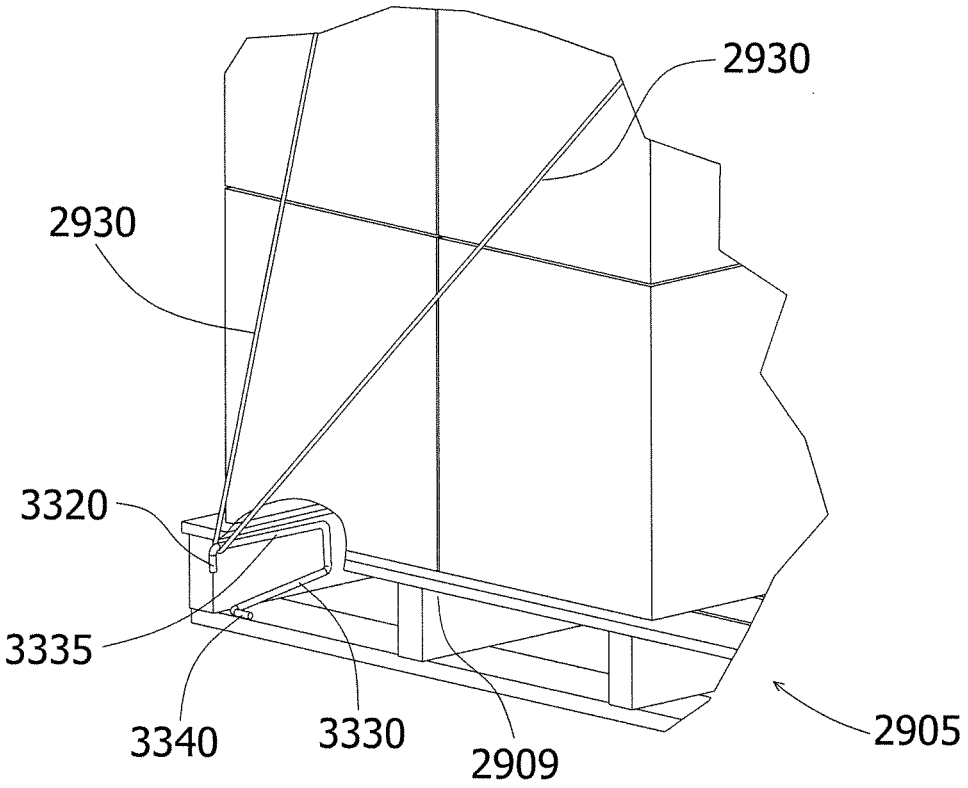
FIG. 35 comprises another perspective view of an example of attachment apparatus like that of FIG. 33 disposed in a pallet and engaging packing material as configured in accordance with various embodiments of the invention.

FIGS. 33-35 illustrate another example attachment apparatus. In this example, the apparatus includes a resilient material configured to engage opposing inner surfaces of a pallet 2905. The apparatus includes a middle elongated portion 3310 configured to be inserted into the pallet 2905 in a generally vertical orientation. A first elongated arm 3330 and a second elongated arm 3335 extending from the middle elongated portion 3310 wherein the elongated arms 3330 and 3335 are disposed to engage the opposing inner surfaces 2907 and 2908 of the pallet 2905. The first elongated arm 3330 is shorter than the second elongated arm 3335 and has an extension arm 3340 extending from an end of the first elongated arm 3330 distal from the middle elongated portion 3310. The extension arm 3340 is configured to engage an inner surface 2908 of the pallet 2905 to restrict rotation of the resilient material in the pallet 2905. The engagement surface 3320 extends from an end of the second elongated arm 3335 distal from the middle elongated portion 3310. The engagement surface 3320 extends beyond an outer edge 2909 of the pallet 2905 to engage a securing material 2930, such as gathered stretch film. One or both of the elongated arms 3330 and 3335 of this example can be disposed to extend from the middle portion 3310 obliquely as illustrated in FIG. 33 to encourage engagement with the pallet 2905. When placed in the pallet 2905, the opposing inner surfaces 2907 and 2908 of the pallet 2905 displace the elongated arms 3330 and 3335 as illustrated in FIG. 34 to create a friction fit, thereby securing the apparatus within the pallet 2905. This example approach can be manufactured from a thick gage metal wire bent to have the described form.

Figure 36:
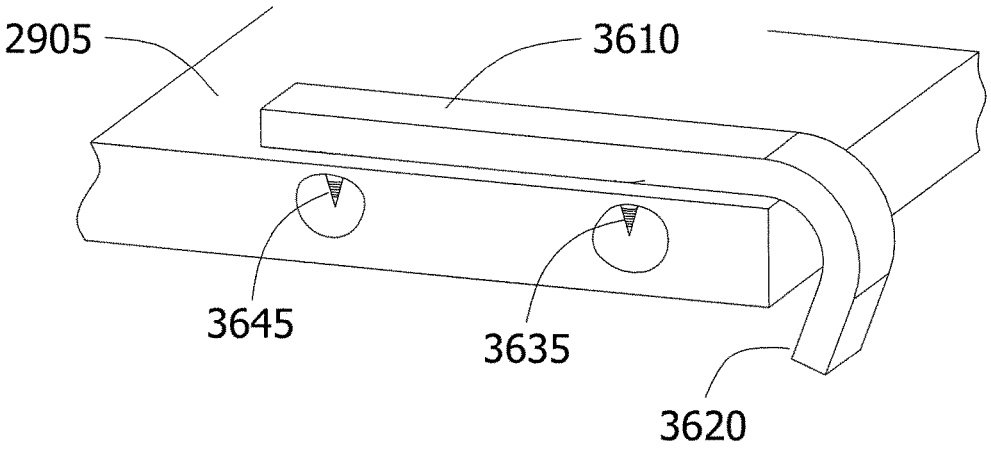
FIG. 36 comprises a perspective view of an example attachment apparatus as configured in accordance with various embodiments of the invention.

FIG. 36 illustrates a further example attachment apparatus. In this example, a body section 3610 supports an engagement surface 3620, which is configured to engage a securing material. A protrusion 3635 extends from the body section 3610 and is configured to be embedded into a surface of a pallet 2905 to secure the body section 3610 and the engagement surface 3620 relative to the pallet 2905. In the illustrated example, the protrusion 3635 has a nail-like profile that can be driven into the pallet 2905. In another example, the protrusion 3635 can be shaped like a nub that embeds only partially into the pallet 2905. Optionally, a second protrusion 3645 extends from a section of the body section 3610 distal from the engagement surface 3620. In this example, the protrusion 3635 is disposed between the second protrusion 3645 and the engagement surface 3620, wherein the second protrusion 3645 is configured to engage or embed into the pallet 2905. For example, the second protrusion 3645 can have a nail-like profile that is driven into the pallet 2905 such that forces on the engagement portion 3620 may torque the attachment device about the first protrusion 3635 to drive the second protrusion into stronger engagement with the pallet 2905.

Figure 37:
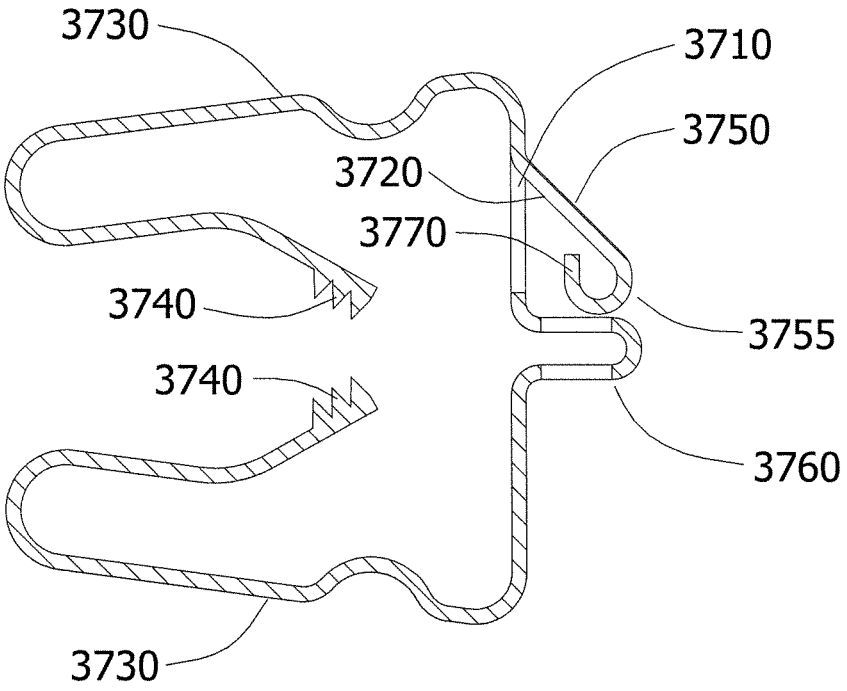
FIG. 37 comprises a side view of an example attachment apparatus as configured in accordance with various embodiments of the invention.
Figure 38:
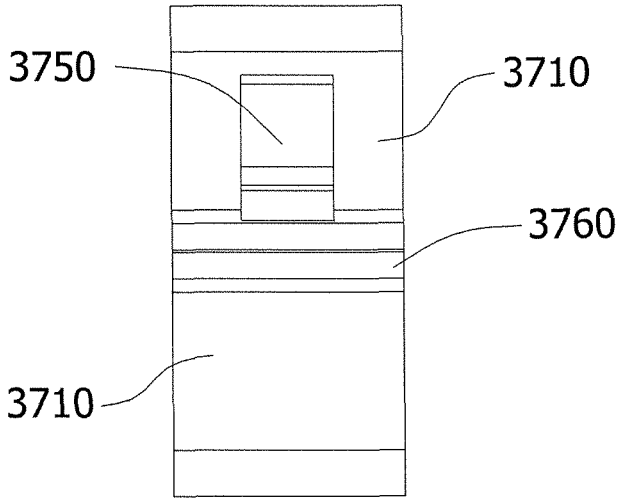
FIG. 38 comprises a front view of the example attachment apparatus of FIG. 37.

FIGS. 37 and 38 illustrate yet another example attachment apparatus including a modification to that of FIGS. 30-32 above. In this version, the attachment apparatus includes a bridge section 3710 and an engagement surface 3720 supported by the bridge section 3710. At least two arms 3730 extend from the bridge section 3710. At least a portion of the at least two arms 3730 are biased to pinch a section of the pallet to secure the apparatus to the pallet. For example, the attachment apparatus may be constructed out of a resilient material like steel or other metal and shaped with a space between the at least two arms 3730 smaller than a typical pallet section to which the device will attach. Thus, the device can spread open, be placed around or slide onto the pallet portion, and grip onto the pallet. In one approach, the attachment apparatus of FIG. 30 can be a single stamped piece of metal, which can cost effective to manufacture. Optionally, a friction surface 3740 is disposed on individual ones of the at least two arms 3730 to engage the pallet.

The engagement surface 3720 in this example is defined by a tab 3750 extending from the bridge section 3710, which in turn defines a ridge 3760 extending from the bridge section 3710 toward a distal end 3755 of the tab 3750. The tab 3750 optionally defines a hook 3770 extending toward the bridge section 3710. The tab/ridge arrangement helps secure the packing material to the attachment apparatus during the wrapping process. For instance, if the tab 3750 and ridge 3760 are close enough, a user would need to depress the tab 3750 to insert the string or rope to be secured to the pallet to effectively lock the string or rope in place. Accordingly, the shape of the ridge 3760 may vary in different applications or when using different manufacturing processes for the apparatus to provide this locking effect.

Various features of the above example attachment apparatuses can be implemented in other ones of the example. For instance, the placement of the friction surface at the very end of the arms 3730 of the FIG. 37 example could be implemented in the example of FIG. 30. The friction surfaces could be applied to any surface of any of the examples expected to contact the pallet. The hook 3770 of the FIG. 37 example could be implemented without the ridge 3760, such as in the FIG. 30 example. Similarly, the ridge 3760 could be implemented without the hook 3770.

So configured, a load can be secured to a pallet using lower cost string or rope made from stretch film instead of metal strapping. The lower cost stretch film string or rope can be secured to the pallet using attachment devices, which themselves can be low cost and reused. Thus, shipment costs can be reduced without loss of performance in load security.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. An apparatus for applying a stretch film to an object, the apparatus comprising:

a support frame configured to support a roll of stretch film and dispense the stretch film in response to tension on the stretch film;

a support member extending approximately parallel to the support to be along a path between the stretch film dispensed from the roll and the object;

a gathering device disposed to stretch and gather the stretch film into a string configured to wrap around the object;

an attachment apparatus configured to attach to a pallet configured to support the object, the attachment apparatus defining an engagement surface configured to engage the string of stretch film to secure the string of stretch film to the pallet, wherein the attachment apparatus comprises:

a single piece of contiguous, flat-formed, resilient metal forming:

a bridge section;

the engagement surface comprising a tab stamped out from the bridge section to define a hook-shaped structure extending from an aperture defined by the bridge section and having a shape corresponding to the tab;

at least two arms extending from the bridge section in a direction opposite of the tab, the at least two arms biased toward each other to pinch a section of the pallet to secure the apparatus to the pallet;

wherein each of the two arms comprises a first section having a distal end extending away from the bridge section and a second section extending from the first section's distal end back toward the bridge section and biased inward toward an opposing arm of the at least two arms to define a friction surface disposed to face a corresponding friction surface defined by the opposing arm's second section.

2. The apparatus of claim 1 wherein the bridge section further defines a ridge extending from the bridge section toward a distal end of the tab.

3. The apparatus of claim 2 wherein the tab bends toward the bridge section.

4. An apparatus for securing shipping materials to a shipping pallet, the apparatus comprising:

a single piece of contiguous, flat-formed, resilient metal forming:

a bridge section;

a tab stamped out from the bridge section to define a hook-shaped structure extending from an aperture defined by the bridge section and having a shape corresponding to the tab;

at least two arms extending from the bridge section in a direction opposite of the tab, the at least two arms biased toward each other to pinch a section of a shipping pallet to secure the apparatus to the pallet;

wherein each of the two arms comprises a first section having a distal end extending away from the bridge section and a second section extending from the first section's distal end back toward the bridge section and biased inward toward an opposing arm of the at least two arms to define a friction surface disposed to face a corresponding friction surface defined by the opposing arm's second section.

5. The apparatus of claim 4 wherein the bridge section further defines a ridge extending from the bridge section toward a distal end of the tab.

6. The apparatus of claim 5 wherein the tab defines the hook-shaped structure as extending toward the bridge section.

7. A method for securing an object to a pallet, the method comprising:

engaging at least one surface of a pallet with an attachment apparatus to dispose an engagement surface of the attachment apparatus outside of an outer edge of the pallet, the attachment apparatus comprising:

a single piece of contiguous, flat-formed, resilient metal forming:

a bridge section;

the engagement surface comprising a tab stamped out from the bridge section to define a hook-shaped structure extending from an aperture defined by the bridge section and having a shape corresponding to the tab;

at least two arms extending from the bridge section in a direction opposite of the tab, the at least two arms biased toward each other to pinch a section of the pallet to secure the apparatus to the pallet;

wherein each of the two arms comprises a first section having a distal end extending away from the bridge section and a second section extending from the first section's distal end back toward the bridge section and biased inward toward an opposing arm of the at least two arms to define a friction surface disposed to face a corresponding friction surface defined by the opposing arm's second section;

engaging the engagement surface with at least one elongated strip of packing material;

wrapping the object with the packing material to secure the packing material to the pallet through a secure engagement of the packing material to the engagement surface of the attachment apparatus;

wherein the engaging the at least one surface with the attachment apparatus comprises pinching a section of the pallet with the at least two arms.

8. The method of claim 7 further comprising engaging the pallet with the friction surface disposed on individual ones of the at least two arms.

* * * * *